US011753881B2

(12) United States Patent
Patterson et al.

(10) Patent No.: US 11,753,881 B2
(45) Date of Patent: Sep. 12, 2023

(54) TUBULAR DETECTION SYSTEM FOR A FINGERBOARD

(71) Applicant: Nabors Drilling Technologies USA, Inc., Houston, TX (US)

(72) Inventors: John Patterson, Cypress, TX (US); Scott Boone, Houston, TX (US)

(73) Assignee: Nabors Drilling Technologies USA, Inc., Houston, TX (US)

( * ) Notice: Subject to any disclaimer, the term of this patent is extended or adjusted under 35 U.S.C. 154(b) by 253 days.

(21) Appl. No.: 17/139,071

(22) Filed: Dec. 31, 2020

(65) Prior Publication Data

US 2021/0215007 A1 Jul. 15, 2021

Related U.S. Application Data

(60) Provisional application No. 62/960,530, filed on Jan. 13, 2020.

(51) Int. Cl.
*E21B 19/14* (2006.01)
*E21B 19/20* (2006.01)

(52) U.S. Cl.
CPC ..... *E21B 19/20* (2013.01)

(58) Field of Classification Search
CPC ..... E21B 19/14; E21B 19/20; E21B 19/165; E21B 19/00; E21B 19/16
See application file for complete search history.

(56) References Cited

U.S. PATENT DOCUMENTS 4,531,875 A 7/1985 Krueger
4,621,974 A * 11/1986 Krueger ..... E21B 19/20 414/800
7,878,254 B2 2/2011 Abdollahi et al.
10,837,242 B2 * 11/2020 Magnuson ..... B65G 1/0442
11,402,205 B2 * 8/2022 Finlay ..... G01C 9/08
11,519,230 B2 * 12/2022 Finlay ..... E21B 47/13
2012/0152619 A1 * 6/2012 Hofste ..... E21B 19/06 175/48
2013/0133899 A1 * 5/2013 Holliday ..... E21B 3/02 166/380
2013/0275100 A1 * 10/2013 Ellis ..... E21B 19/20 703/2
2019/0063167 A1 * 2/2019 Kunec ..... E21B 19/14
2020/0394779 A1 * 12/2020 Ayanambakkam ..... G06T 7/70
2021/0164303 A1 * 6/2021 Valen ..... E21B 19/155

FOREIGN PATENT DOCUMENTS

WO 2019/102222 A1 5/2019

* cited by examiner

*Primary Examiner* — Kipp C Wallace

(74) *Attorney, Agent, or Firm* — Abel Schillinger, LLP

(57) ABSTRACT

A system comprising a rig, a fingerboard, a first sensor, and a second sensor, with the first sensor positioned on an opposite side of the entrance from the second sensor, where the first sensor and the second sensor are used to detect when a tubular enters or exits the fingerboard and to detect a parameter of the tubular, such as diameter of the tubular, speed of the tubular, and an angle of entry of the tubular. A method comprising sensing, via first and second sensors, when a tubular is entering a fingerboard through an entrance of the fingerboard, restricting movement of a top drive at an elevated position until the first and second sensors sense the tubular entering the fingerboard, and enabling movement of the top drive when the first and second sensors sense the tubular entering the fingerboard.

19 Claims, 17 Drawing Sheets

TUBULAR DETECTION SYSTEM FOR A FINGERBOARD

CROSS-REFERENCE TO RELATED APPLICATION(S)

This application claims priority under 35 U.S.C. § 119(e) to U.S. Patent Application No. 62/960,530, entitled "TUBULAR DETECTION SYSTEM FOR A FINGERBOARD," by John PATTERSON et al., filed Jan. 13, 2020, which is assigned to the current assignee hereof and incorporated herein by reference in its entirety.

TECHNICAL FIELD

The present invention relates, in general, to the field of drilling and processing of wells. More particularly, present embodiments relate to a system and method for detecting characteristics of a tubular as it enters or exits a fingerboard during a subterranean operation.

BACKGROUND

On some rigs in the oil and gas industry, segmented tubular strings are used to extend a wellbore through a subterranean formation or to perform other operations with the wellbore during subterranean operations at the rig site. During these operations (e.g. drilling, completion, treating, killing, etc.), a segmented tubular string can be "tripped" into or out of the wellbore by rig operators and rig equipment. Some rigs have vertical storage locations for tubulars on the rig (e.g. fingerboards, setbacks, etc.) which can support efficient tripping in or out of the wellbore.

In general, when tripping the segmented tubular string from the wellbore, a top drive with an elevator can raise the tubular string up out of the wellbore a distance equal to the tubular segment that is to be removed from the top end of the tubular string. When the tubular string has been elevated to the appropriate height, the tubular segment can be disconnected from the tubular string and moved over to a vertical storage location in a fingerboard. When the tubular string is hoisted to the desired height, a plurality of slips can engage the tubular string to prevent it from dropping back into the wellbore. With the tubular string suspended by the slips, the tubular segment can then be removed from the tubular string. The top drive can then be disconnected from the top of the tubular segment. An operator at the fingerboard can then reach out from a platform of the fingerboard to unlatch the tubular segment from the elevator and pull the top of the tubular segment toward the fingerboard. At the same time an operator on the rig floor can be moving the bottom end of the tubular segment from the well center to a designated location under the fingerboard. An operator on the rig floor can move the bottom end of the tubular segment from the well center to a designated location under the fingerboard. Once the bottom of the tubular segment in placed on the rig floor, an operator, or mechanized equipment at the fingerboard can then reach out from a platform of the fingerboard to unlatch the tubular segment from the elevator and pull the top of the tubular segment toward the fingerboard.

Another operator on the rig floor can be controlling the raising and lowering of the top drive. If the synchronization of these activities works as desired, then the operators can successfully remove the tubular segment from the well center in time for the top drive to be lowered to the rig floor to latch the top of the tubular string with the elevator in preparation for again hoisting a desired length of the tubular string from the wellbore. However, a condition can occur (and does occur) where, for whatever reason, the operator on the platform fails to move the top of the tubular segment away from the well center enough to clear the top drive before the top drive is lowered. In this instance, the top drive can impact the top of the tubular segment, but with the bottom of the tubular segment already on the rig floor, the tubular segment can be released from the impact with the top drive like releasing a coiled spring under compression.

As a result, since neither the top or the bottom of the tubular segment is constrained, it can spring from the rig floor in any direction, the bottom can be kicked out from where the drill floor operator is trying to manipulate it, as well as many other unknown and uncontrolled outcomes that can occur when the tubular segment is impacted by the top drive. These uncontrolled outcomes are very unsafe for the operators on the rig and can result in serious injury each time they occur. There is also the possibility of an operator failing to guide the tubular into the elevators when tripping into the wellbore. In this instance, the tubular will not be constrained at the top, and will fall from the fingerboard in an unpredictable manner. It is very difficult to retrieve these tubulars if either of the described failures occur. Therefore, improvements in the systems for tripping in and out a tubular string at a rig site are continually needed.

SUMMARY

In accordance with an aspect of the disclosure, a system can include a rig, a fingerboard on the rig, the fingerboard having an entrance and a plurality of tubular storage locations, and first and second sensors, with the first sensor positioned on an opposite side of the entrance from the second sensor, with the first sensor and the second sensor being configured to detect when a tubular enters or exits the fingerboard and configured to detect a parameter of the tubular as the tubular enters or exits the fingerboard.

In accordance with another aspect of the disclosure, a system can include a rig, a top drive configured to lift and lower a tubular string in a wellbore, a fingerboard on the rig, the fingerboard having an entrance and a plurality of tubular storage locations, and a first sensor and a second sensor, with the first sensor positioned on an opposite side of the entrance from the second sensor, where the first sensor and the second sensor detect when a tubular passes an entrance of the fingerboard, and where movement of the top drive is halted until either one of the first sensor and the second sensor detect the tubular.

In accordance with another aspect of the disclosure, a method can include the operations of sensing, via first and second sensors, when a tubular is entering a fingerboard through an entrance of the fingerboard, halting a top drive at an elevated position until the first and second sensors sense the tubular entering the fingerboard, and enabling movement of the top drive when the first and second sensors sense the tubular entering the fingerboard.

BRIEF DESCRIPTION OF THE DRAWINGS

These and other features, aspects, and advantages of present embodiments will become better understood when the following detailed description is read with reference to the accompanying drawings in which like characters represent like parts throughout the drawings, wherein.

DETAILED DESCRIPTION

The following description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings.

As used herein, the terms "comprises," "comprising," "includes," "including," "has," "having," or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

The use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise.

The use of the word "about", "approximately", or "substantially" is intended to mean that a value of a parameter is close to a stated value or position. However, minor differences may prevent the values or positions from being exactly as stated. Thus, differences of up to ten percent (10%) for the value are reasonable differences from the ideal goal of exactly as described. A significant difference can be when the difference is greater than ten percent (10%).

Figure 1A:
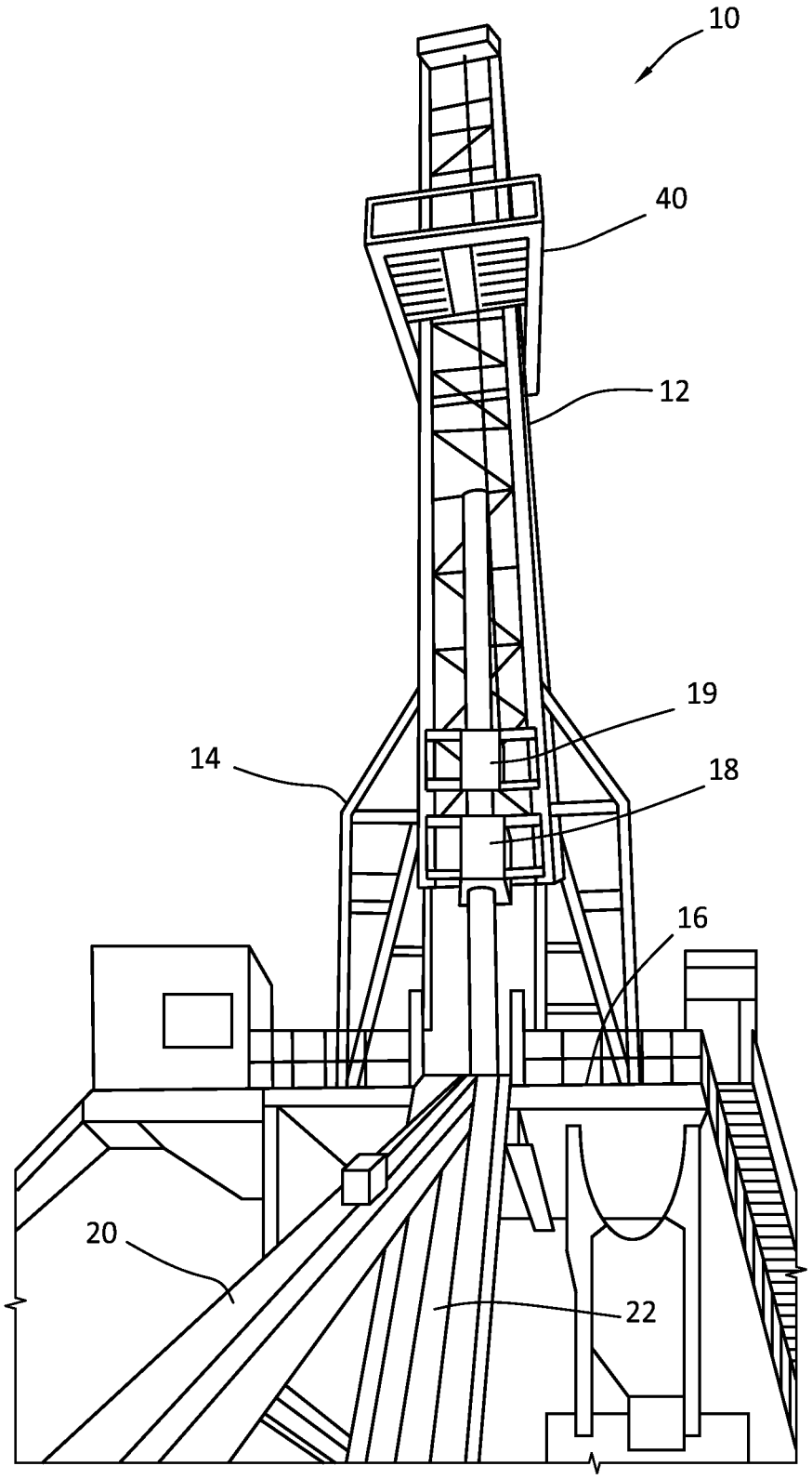
FIG. 1A is a representative side view of a rig being utilized for a subterranean operation (e.g. drilling a wellbore) with a fingerboard for vertical storage of tubulars, in accordance with certain embodiments.

FIG. 1A is a representative side view of a rig 10 in the process of a subterranean operation in accordance with certain embodiments which may require providing tubulars to and removing tubulars from a fingerboard 40 of the rig 10. In this example, the rig 10 is in the process of drilling a wellbore 15 (see FIG. 2), but the current embodiments are not limited to a drilling operation. The rig 10 can also be used for other operations such as completion, production, recovery, well killing operations, etc. The rig 10 features an elevated rig floor 16 and a derrick 14 extending above the rig floor 16. A traveling block 19 is configured to hoist various types of drilling equipment above the rig floor 16, such as a top drive 18. A mast 12 of the derrick 14 extends above the rig floor 16 and can provide rotational stability to the top drive 18 as well as support for the fingerboard 40. A catwalk 20 can be used to transfer tubulars between a horizontal storage area and the rig floor 16. The catwalk 20 is shown after it has traveled up a V-door ramp 22 to a V-door at the rig floor 16. A pipe handler can be used to transfer the tubulars between the catwalk 20, the fingerboard 40, the wellbore 15, as well as other rig 10 locations.

Figure 1B:
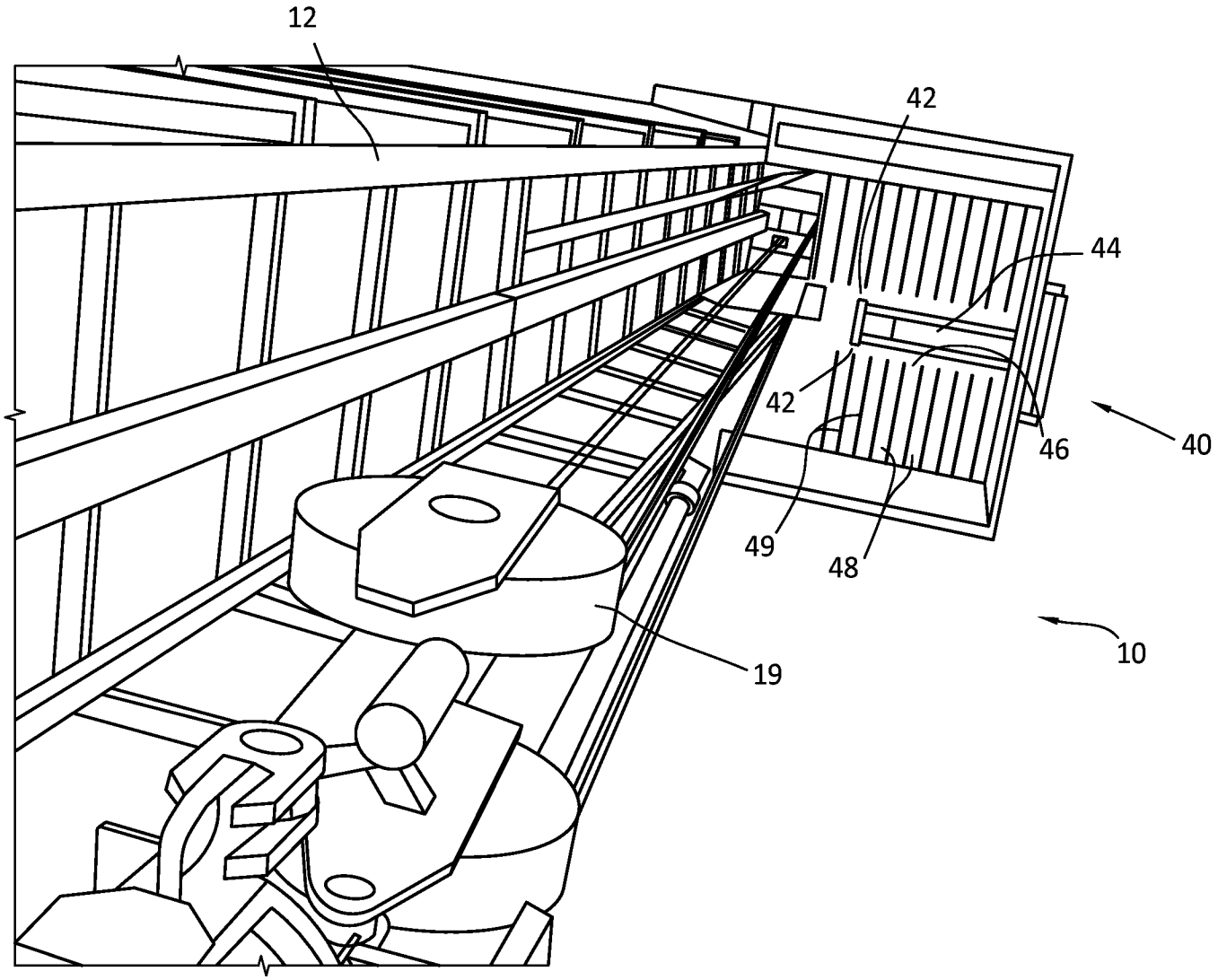
FIG. 1B is a representative perspective view of a bottom side of the fingerboard of the rig of FIG. 1A, in accordance with certain embodiments.

FIG. 1B is a representative perspective view of a bottom side of the fingerboard of the rig 10 of FIG. 1A, in accordance with certain embodiments. The fingerboard 40 can have channels 48 formed by protruding fingers 49. This example fingerboard 40 has two rows of channels 48, with the protruding fingers 49 of each row extending toward each other with a platform 44 positioned in between the two rows. This platform can be used as a structure for personnel to walk on to manually maneuver tubulars into and out of the fingerboard storage. Channels 46 can be formed on either side of the platform 44 with the channels 46 being perpendicular to the channels 48. As tubulars enter the channels 46 at the entrance 42, they can be directed to various storage locations. The tubulars can also be moved for a storage location, along a channel 46 to exit the fingerboard from the entrance 42. The fingerboard 40 can be bordered by a structure that helps prevent tubulars from tilting over and falling out of the fingerboard 40 as they are being retrieved from or installed in the fingerboard storage locations.

Figure 2:
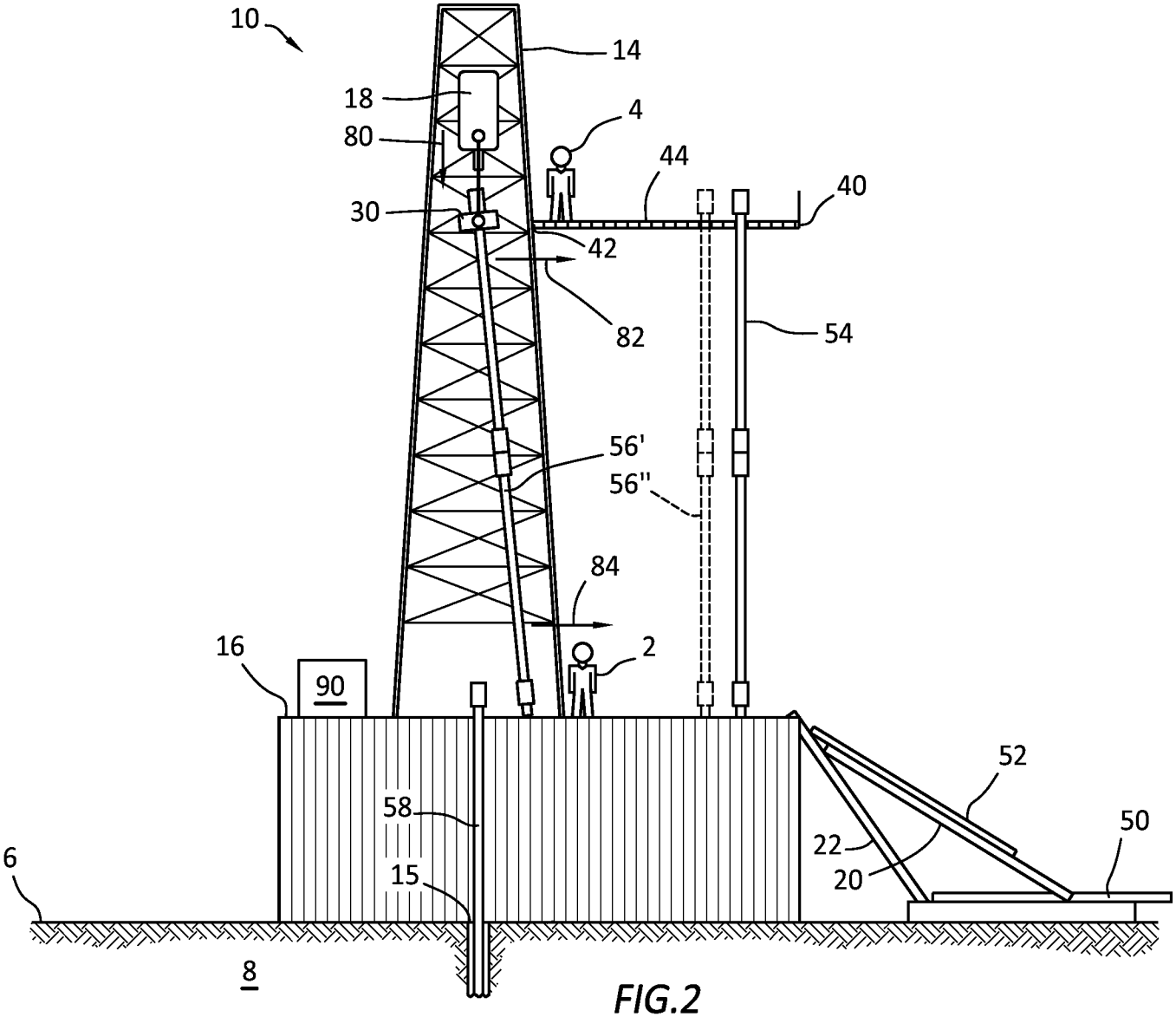
FIGS. 2-3 are representative simplified side views of a rig being utilized for a subterranean operation, in accordance with certain embodiments.

FIG. 2 is a representative simplified side view of a rig 10 being utilized for a subterranean operation (e.g. drilling a wellbore), in accordance with certain embodiments. The rig 10 can include a derrick 14 extending up from the rig floor 16. The derrick 14 can provide support for hoisting the top drive 18 as needed to manipulate tubulars. A catwalk 20 and V-door ramp 22 can be used to transfer horizontally stored tubular segments 50 to the rig floor 16. A tubular segment 52 can be one of the horizontally stored tubular segments 50 that is being transferred to the rig floor 16, via the catwalk 20. As used herein, "tubular" refers to an elongated cylindrical tube and can include any of the tubulars manipulated around the rig 10, such as tubular segments 50, 52, tubular stands 54, 56, and tubular string 58, but not limited to the tubulars shown in FIG. 2. Therefore, "tubular" can refer to "tubular segment," "tubular stand," and "tubular string," as well as "pipe," "pipe segment," "pipe stand," and "pipe string."

FIG. 2 shows a tubular 56 being removed from the tubular string 58. The top drive 18 has been raised to a desired height to allow the tubular 56 to be disconnected from the tubular string 58 while slips (not shown) hold the tubular string 58 suspended from the drill floor 16. With the bottom of the tubular 56 disconnected and resting on the drill floor 16, the operator 2 can move (arrow 84) the tubular 56 from position 56' to position 56". The operator 4 can release the top of the tubular 56 from the elevator 30 and move (arrow 82) the tubular 56 from position 56' to position 56" through the entrance 42 of the fingerboard 40. The movement 82 of the upper end of the tubular 56 should clear the tubular 56 from the path of the top drive 18 before the top drive 18 begins moving (arrow 80) back down toward the drill floor 16.

The top drive 18 can again engage the tubular string 58 with the elevator 30 and raise the tubular string 58 to remove another tubular 56. One way to ensure that the tubular 56 does not engage the top drive 18 when the top drive 18 moves toward the drill floor 16 can be to detect when the top of the tubular 56 at least begins to enter the fingerboard at the entrance 42. When the tubular 56 begins to enter the entrance 42, sensors can detect the presence of the tubular 56 entering or exiting the entrance 42 and communicate the detection data to a rig controller 90. An operator (or rig controller 90) can then begin a descent of the top drive 18 with assurance that the tubular 56 is safely removed from the top drive's path. As used herein, the "rig controller" can include one or more processors. The processors can be distributed about the rig 10, such as the drill floor 16 and the fingerboard 40. The processors can be coupled together via a wired or wireless network. The processors can also include remotely located processors that can be coupled to local processors on the rig 10 via a wired or wireless network.

Figure 3:
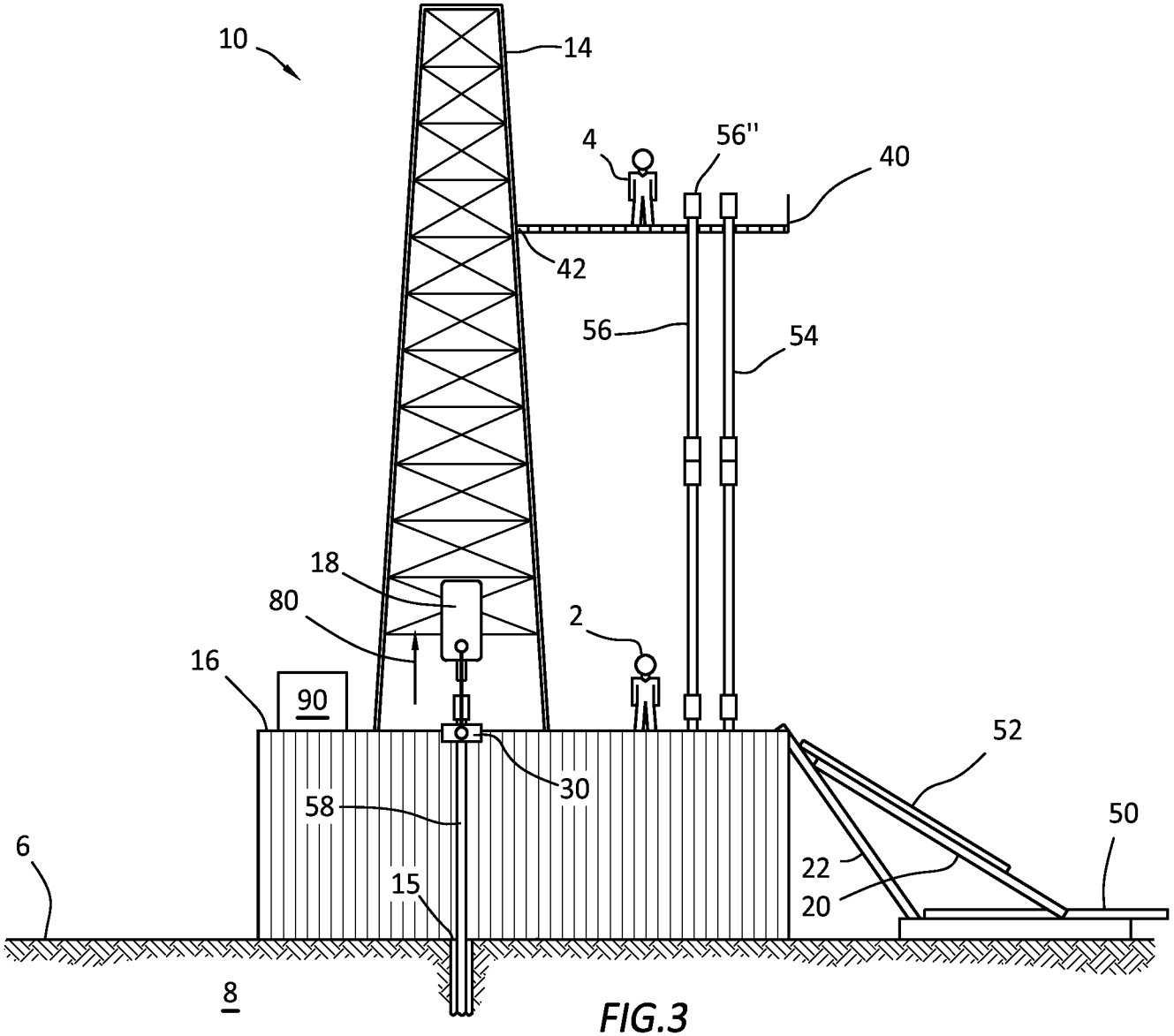

FIG. 3 shows the tubular 56 positioned in the fingerboard 40 at the location 56" with the top drive 18 lowered to engage the elevator 30 with the tubular string 58. The top drive 18 can then be controlled to hoist a portion of the tubular string 58 from a wellbore 15 that is formed through a surface 6 of the subterranean formation 8. The operations illustrated by FIGS. 2 and 3 can be repeated for as many times as needed to remove the tubular string 58 (or at least a portion of the tubular string 58) from the wellbore 15. Performing these operations in reverse order can be used to trip the tubular string 58 into the wellbore 15 by adding successive tubulars 56 to the tubular string 58.

Figure 4:
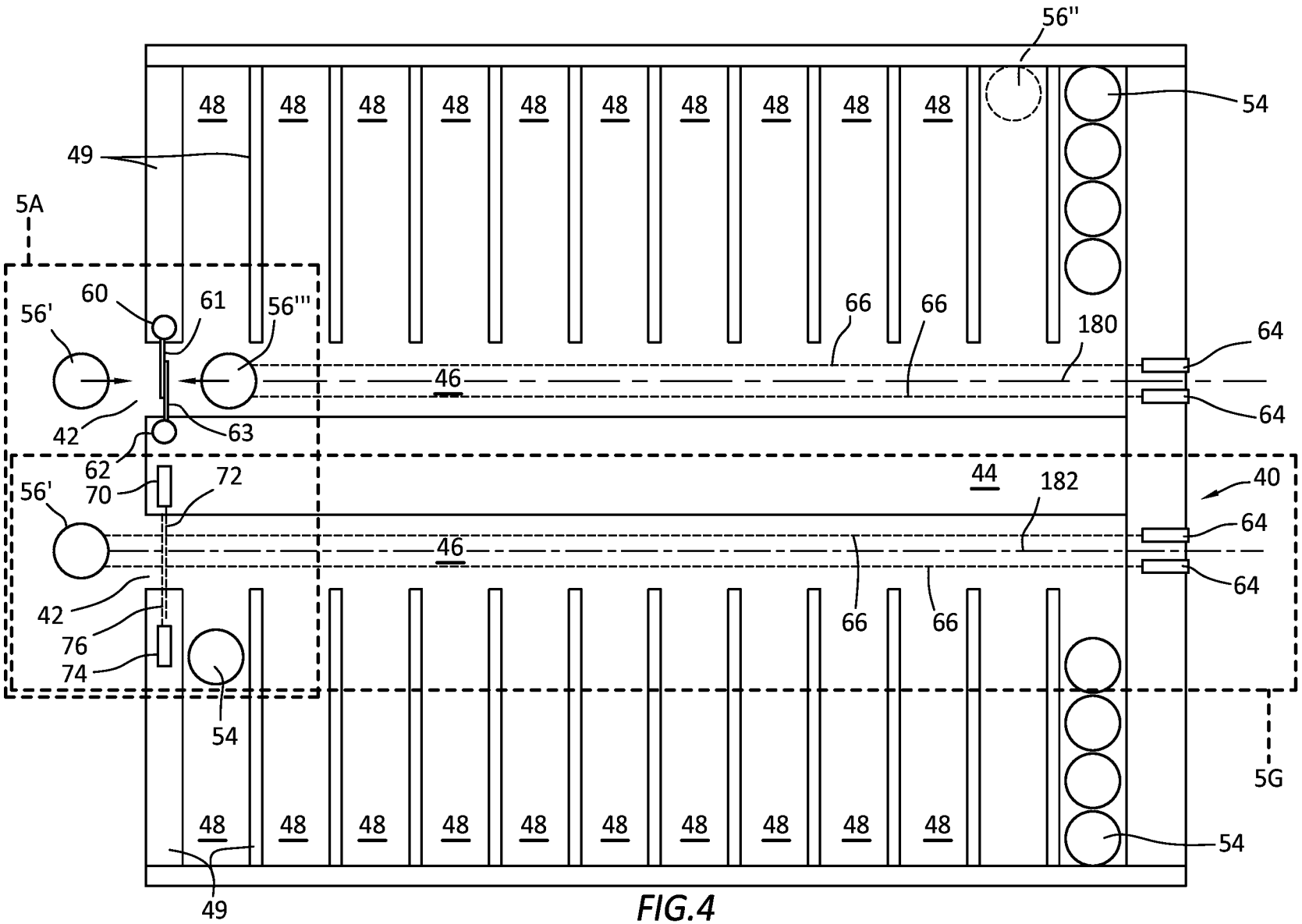
FIG. 4 is a representative top view of a fingerboard on a rig, in accordance with certain embodiments.

FIG. 4 is a representative top view of a fingerboard 40 on a rig 10. The fingerboard 40 can have size and shape variations, but many will have two rows of channels 48, with the protruding fingers 49 of one row extending toward the protruding fingers 49 of the other row with the platform 44 positioned in between the two rows. The protruding fingers 49 define the channels 48. This platform 44 can be used as a structure for personnel to walk on to manually maneuver tubulars 56 into and out of the fingerboard storage. Channels 46 can be formed on either side of the platform 44, with the channels 46 being perpendicular to the channels 48. The fingerboard 40 shows many empty storage locations in the channels 48. However, some tubulars 54 are shown stored in the channels 48. A tubular 56 can enter a channel 46 at the entrance 42 (e.g. at position 56') and be directed to a storage location in the fingerboard 40 (e.g. at position 56"). A tubular 56 can also be moved from a storage location (e.g. at position 56") in the fingerboard 40, along a channel 46 (e.g. at position 56'") to exit the fingerboard from the entrance 42.

Sensors 60, 62 can be positioned at the entrance 42 on either side of the channel 46. These sensors 60, 62 can indicate when a tubular 56 is entering or exiting the channel 46 at the entrance 42. The sensors 60, 62 will be described in more detail below. However, these sensors 60, 62 can be referred to as swing gate sensors where each sensor 60, 62 can include an arm 61, 63, respectively, that can rotate (arrows 92, 94; see FIG. 5A) about an axis 68, 69 of the sensor 60, 62, respectively. Each sensor 60, 62 can include a biasing device that returns the respective arms 61, 63 back to an initial azimuthal position after being deflected by an object (e.g. a tubular 56). Each sensor 60, 62 can also include an encoder 98, 99 or other device that detects rotation of the arm 61, 63, respectively, and can communicate to the rig controller 90 (see FIG. 3) the degrees (or arc length) about the axis 68, 69 the arm 61, 63 has rotated from an initial azimuthal position 96 (see FIG. 5B).

Therefore, as these arms 61, 63 are rotated away from and back to the initial azimuthal position 96, the encoder 98, 99 can detect the angle of rotation of the arms 61, 63 from the initial azimuthal position 96 and communicate the sensor data to the rig controller 90, which can capture the sensor data, store the sensor data in a non-transitory memory system, and can create plots of the sensor data vs. time (or another parameter) for analysis or reporting to operators. The sensor data can be used to detect a presence of a tubular 56 at the entrance 42, a direction the tubular 56 is traveling through the entrance 42, a speed the tubular 56 is traveling through the entrance 42, a diameter of the tubular 56, and whether the tubular 56 is centered in the channel 46 or traveling at an angle along the channel 46 at the entrance 42.

Other sensors can be used to detect parameters of a tubular 56 at the entrance 42, such as sensors 70, 74. These sensors 70, 74 may be optical sensors that can detect the distance an object is away from the sensor when the object intersects an optical beam (or stream of pulses) transmitted by the sensor 70, 74. For example, the sensors 70, 74 can be optical Time of Flight LIDAR (Light Detection and Ranging) sensors that can transmit high power optical pulses in short durations (e.g. nanoseconds) to capture depth information from a scene of interest.

The sensors 70, 74 can be positioned on opposite sides of the channel 46 at the entrance 42 to detect parameters of the tubulars 56 as they travel through the entrance 42. The sensor 70, 74 can be arranged toward each other such that the optical beam from each sensor 70, 74 is transmitted toward the other sensor 74, 70. Therefore, when a tubular 56 intersects the beam of one sensor 70, 74 it will also intersect the beam of the other sensor 70, 74.

Additionally, one or more optical sensors 64 (e.g. optical LIDAR sensors) can be positioned at an opposite end of the channel 46 from the entrance 42, with the optical beams 66 of each sensor directed toward the entrance 42 and parallel with the channel 46. These sensors 64 can be used to determine if a tubular 56 is present in the channel 46 of the fingerboard 40. Therefore, when a tubular 54, 56 is removed from a storage location, the sensors 64 can detect when it enters the channel 46 and when it leaves the channel 46. Multiple sensors 64 can be used for each channel 46 to ensure that the tubulars 54, 56 are detected regardless of the width of the channel 46 or the diameters of the tubulars 54, 56.

FIGS. 5A-5F show a more detailed view of the area 5A in FIG. 4 for a more detailed discussion of the operation of the sensors 60, 62, 70, 74 when a tubular 56 enters or exits a channel 46 through an entrance 42. The first description regarding FIGS. 5A-5F focuses on the operation of the sensors 60, 62, with a follow-on description regarding FIGS. 5A-5F focusing on the operation of the sensors 70, 74. FIGS. 5A-5F illustrate a tubular 56 entering the channel 46 through the entrance 42. However, it should be understood that the description of the sensors at the entrance 42 detecting a tubular entering the channel 46 is similarly applicable to a tubular passing through the entrance 42 as the tubular exits the channel 46. Therefore, descriptions of determining speed through the entrance 42, direction through the entrance 42, angle of travel of the tubular 54 through the entrance 42 is similarly applicable to a tubular 56 entering the channel 46 or a tubular 56 exiting the channel 46.

Operation of Sensors 60, 62 with Reference to FIGS. 5A-5F.

Figure 5A:
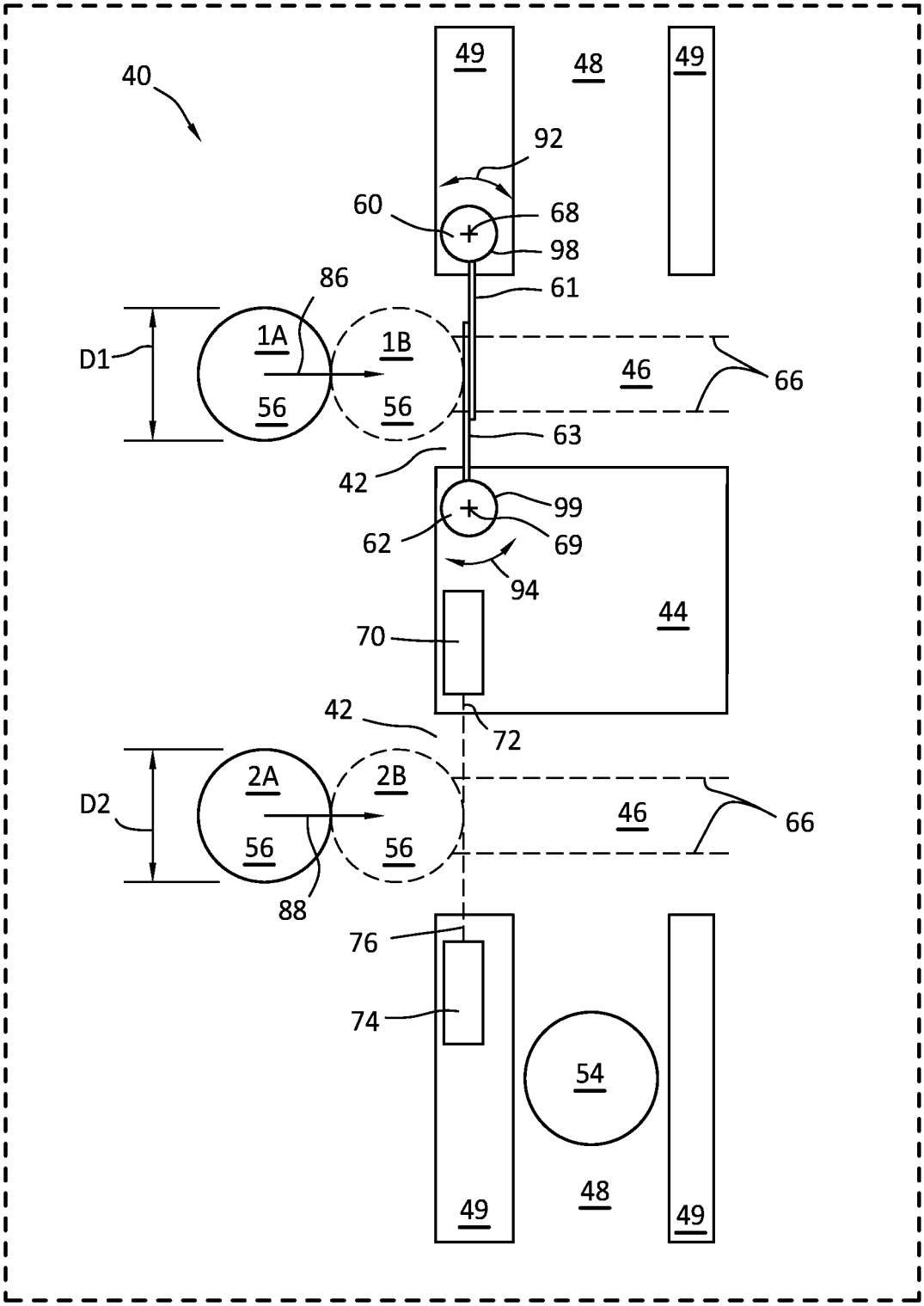
FIGS. 5A-5H are representative functional views of an entrance area of the fingerboard of FIG. 4, in accordance with certain embodiments.

Referring to FIG. 5A, a tubular 56, with diameter D1, is positioned at a location 1A just outside the entrance 42 of the upper (or off driller side) channel 46. The tubular 56 can move in direction 86 to location 1B, where the tubular 56 makes initial contact with the sensors 60, 62. It should be understood that FIG. 5A indicates the arm for each sensor 60, 62 is slightly offset from each other. However, it is preferred that the arms directly overlay each other along a center line 96 (see FIG. 5B) which can be the initial azimuthal position of the arms 61, 63. Therefore, when the tubular 56 contacts one sensor 60, 62, it is preferred (but not required) that the tubular 56 simultaneously contacts the other sensor 62, 60.

When the tubular 56 first contacts the sensors 60, 62, the encoders 98, 99 can detect a slight rotation caused by the contact of the tubular 56 with the arms 61, 63, respectively. Data from the sensors 60, 62 indicating the initial detection can be communicated to the rig controller 90. This initial detection indicating a presence of the tubular 56 at the entrance 42 can be used by the rig controller 90 to enable (either directly or via an operator remotely) lowering of the top drive 18 toward the rig floor 16. As the tubular 56 continues to travel in the direction 86, the sensors 60, 62 can communicate sensor data to the rig controller 90 on a real-time basis. The sensor data can include a time stamp for each time the sensor 60, 62 measures a parameter value. For example, the swing gate sensors 60, 62 can measure the angle of rotation of the arms 61, 63 and store the parameter values (along with other meta-data such as time stamps) in the sensors 60, 62 for later transmission to the rig controller 90, or the sensors 60, 62 can communicate the parameter values to the rig controller 90 in real time.

Figure 5B:
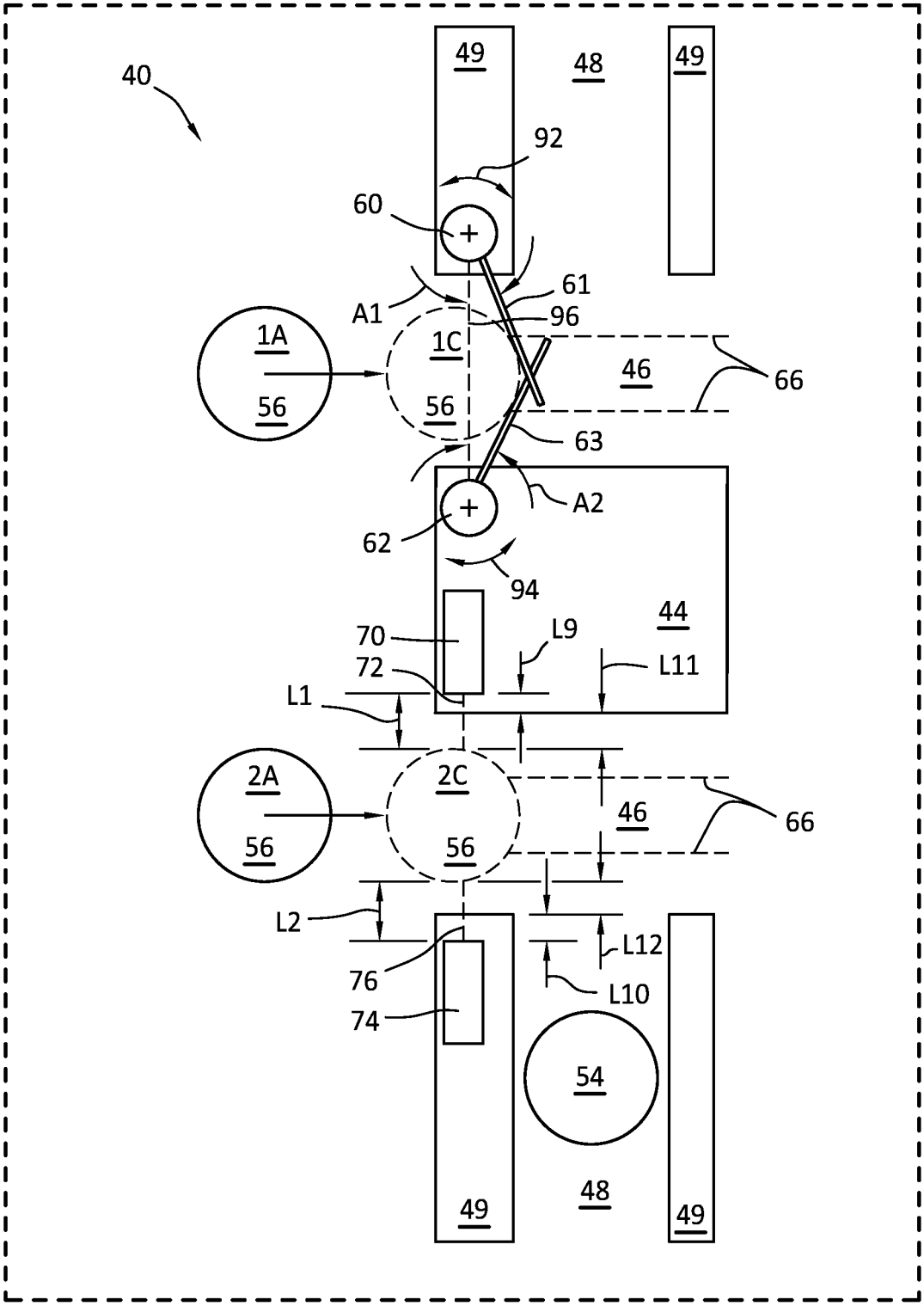

Referring to FIG. 5B, the tubular 56 has moved in the direction 86 to location 1C, where the tubular 56 has deflected the arms 61, 63 of the sensors 60, 62 away from the initial azimuthal position 96. Respectively, the encoder 98, 99 of the sensor 62, 63 can measure the angle A1, A2, which represents how much the arm 61, 63 has been rotated 92, 94 from the initial azimuthal position 96. Respectively, the encoder 98, 99 can measure the angle A1, A2 as the tubular 56 continues to move through the entrance 42. Therefore, the rig controller 90 can analyze the sensor data from the sensors 60, 62 and create a plot of the sensor data vs. time (or another parameter, such A1 vs. A2). The plot can be used to determine various parameters of the tubular 56, when the tubular passes through the entrance 42. For example, if the tubular 56 is traveling along the center axis 180 of channel 46, then the angles A1 and A2 will be substantially equal. Variations between angle A1 and angle A2 can indicate that the tubular 56 is entering the entrance 42 at an angle from the center axis 180 or at least offset from the axis 180.

Figure 5C:
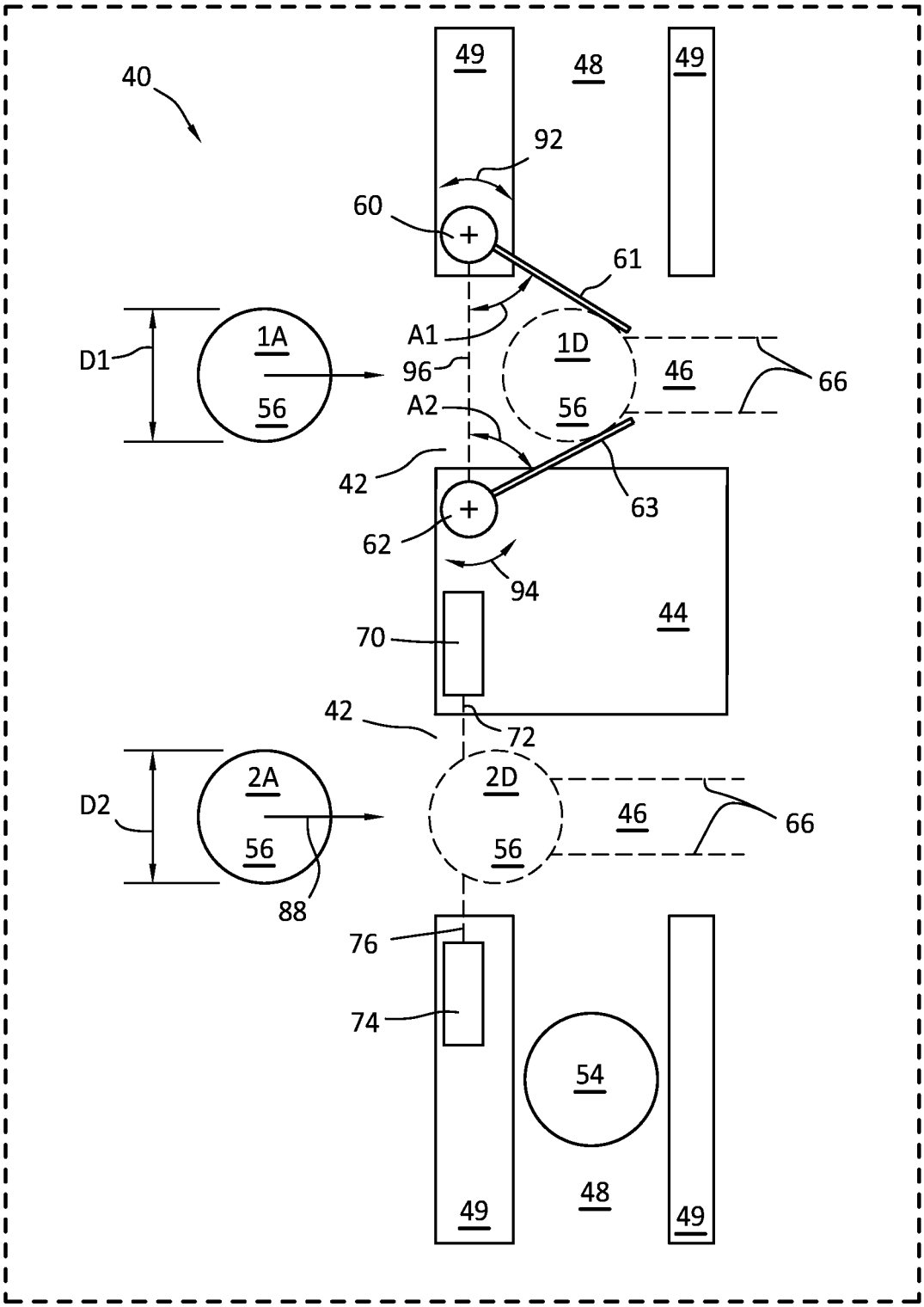

Referring to FIG. 5C, the tubular 56 has moved further in the direction 86 to location 1D, where the tubular 56 further deflects the arms 61, 63 of the sensors 60, 62. Respectively, the encoder 98, 99 of the sensor 62, 63 can continue to measure the angle A1, A2. The example shown in FIG. 5C illustrates the deflection of the arms 61, 63 when the tubular 56 enters the channel 46 through the entrance 42 along the center axis 180.

Figure 5D:
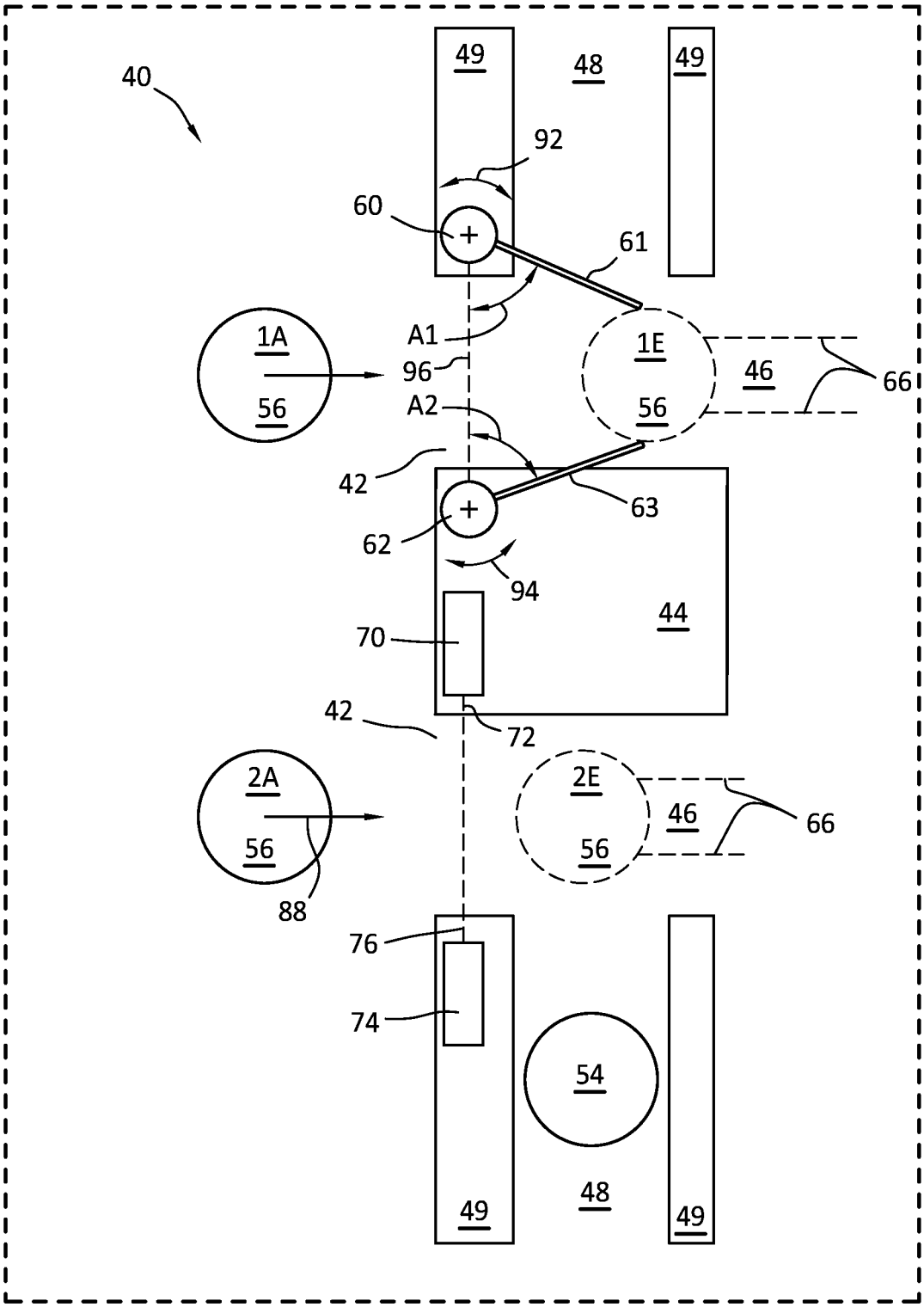

Referring to FIG. 5D, the tubular 56 has moved further in the direction 86 to location 1E, where the tubular 56 has deflected the arms 61, 63 to their maximum rotation. Respectively, the encoder 98, 99 of the sensor 62, 63 can continue to measure the angle A1, A2. When receiving the sensor data including the angles A1, A2 and with the rig controller 90 knowing the length of the arms 61, 63, the rig controller 90 can calculate the distance between the ends of the arms 61, 63. With the tubular 56 at location 1E, the arms 61, 63 have been rotated 92, 94 to their maximum rotation. Therefore, the distance between the ends of the arms 61, 63 is substantially equivalent to the diameter D1 of the tubular 56.

Therefore, the pair of sensors 60, 62 along with the rig controller 90 can be used to determine a diameter D1 of the tubular 56 that enters the channel 46 based on the sensor data and the known physical dimensions of the fingerboard 40 and the locations of the sensors 60, 62. This can be used as a check or validation of the expected diameter of the tubular 56. If the actual diameter and the expected diameter do not match, the rig controller 90 can alert the operators, who can then take corrective action. It should also be understood that the rig controller 90 can autonomously take corrective action, without operator involvement. Additionally, since the sensor data (which can include the angles A1, A2) can be time stamped, the rig controller 90 can determine (from analyzing the sensor data) the speed of the tubular 56 as it passes through the entrance 42. Furthermore, if the angles A1, A2 remain substantially equal, then the rig controller 90 can determine that the tubular 56 has entered the channel 46 along the center axis 180. Conversely, if the A1, A2 are not substantially equal, then the rig controller 90 can determine that the tubular 56 has entered the channel 46 at an angle A3 relative to the center axis 180. This is described further below with regards to FIGS. 5E, 5F.

Figure 5E:
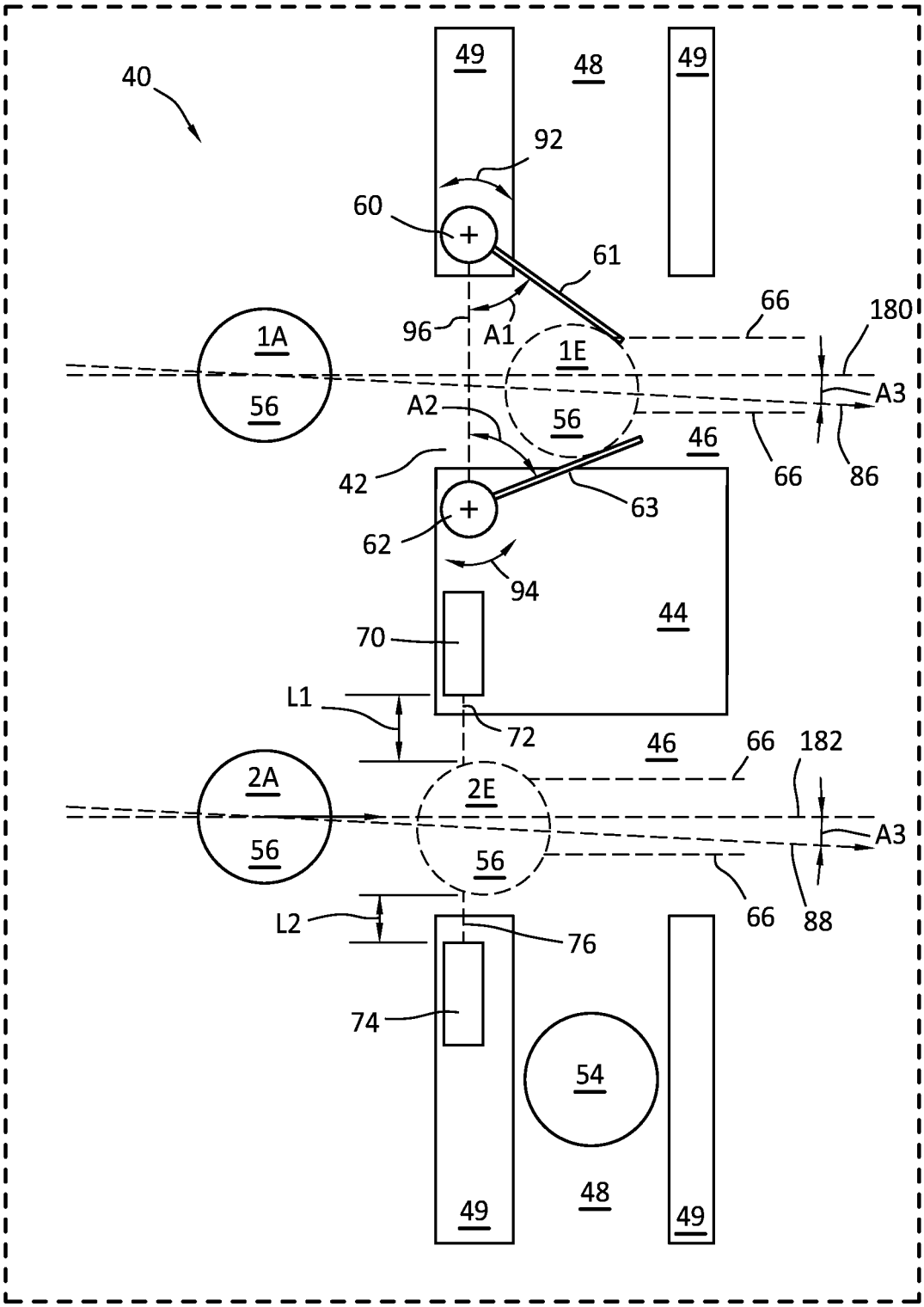

Referring to FIG. 5E, the tubular 56 has moved from location 1A to location 1E in the direction 86, where the tubular 56 has deflected the arms 61, 63 from the initial azimuthal position 96. Respectively, the encoder 98, 99 of the sensor 62, 63 can continue to measure the angle A1, A2. As can be seen, the angles A1 and A2 are not substantially equal. With the tubular 56 at location 1E, the angle A1 is less than the angle A2, because the arm 63 has been rotated more than the arm 61. The difference between the angles A1, A2 can be used to determine an angle A3 that indicates an offset of the direction of travel 86 from the center axis 180. A comparison of the angles A1 and A2 over a time period can also be used to determine the angle of entry or exit of the tubular 56 though the entrance 42.

This can be particularly beneficial when the tubular 56 is being removed from the fingerboard 40 and pushed toward the elevator 30 to be captured by the elevator 30. The angle A3 can indicate if the tubular 56 is correctly directed toward the elevator 30 and if there is a high level of probability that the tubular 56 will be correctly captured by the elevator 30. This direction of travel would be opposite the direction 86 shown in FIG. 5E, since the tubular 56 would be leaving the channel 46, through the entrance 42, and directed toward the elevator 30.

Even when the tubular 56 enters or exits the channel 46, the sensors 60, 62 and the rig controller 90 can be used to determine a presence of the tubular 56 at the entrance 42, a direction of travel 86 of the tubular 56, a diameter D1 of the tubular 56, a speed of the tubular 56 as it passes through the entrance 42, an angle offset A3 relative to the center axis 180 of the direction of travel 86 of the tubular 56, or combinations thereof.

Figure 5F:
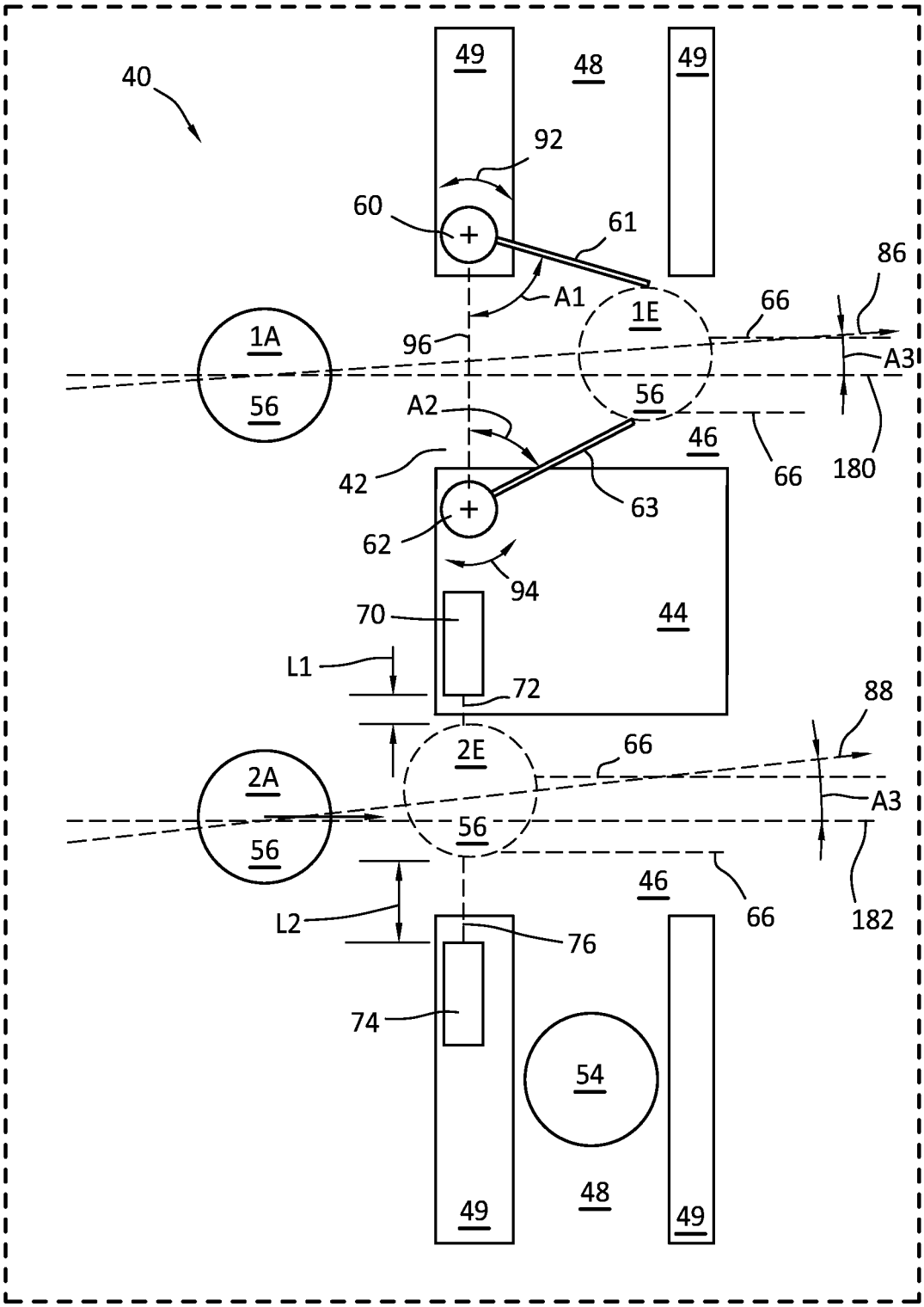

Similar to FIG. 5E, FIG. 5F shows the tubular 56 moving from location 1A to location 1E in the direction 86, where the tubular 56 has deflected the arms 61, 63 from the initial azimuthal position 96. Respectively, the encoder 98, 99 of the sensor 62, 63 can continue to measure the angle A1, A2. As in FIG. 5E, the angles A1 and A2 are not substantially equal. However, in FIG. 5F, the angle A3 is in an opposite direction than in FIG. 5E. With the tubular 56 at location 1E, the angle A1 is greater than the angle A2, because the arm 61 has been rotated more than the arm 63. The difference between the angles A1, A2 can be used to determine an angle A3 that indicates an offset of the direction of travel 86 from the center axis 180. A comparison of the angles A1 and A2 over a time period can also be used to determine the angle of entry or exit of the tubular 56 though the entrance 42.

Even when the tubular 56 enters or exits the channel 46 offset from the center axis 180, the sensors 60, 62 and the rig controller 90 can be used to determine a presence of the tubular 56 at the entrance 42, a direction of travel 86 of the tubular 56, a diameter D1 of the tubular 56, a speed of the tubular 56 as it passes through the entrance 42, an angle offset A3 relative to the center axis 180 of the direction of travel 86 of the tubular 56, or combinations thereof.

Operation of Sensors 70, 74 with Reference to FIGS. 5A-5F.

Referring to FIG. 5A, a tubular 56, with diameter D2, is positioned at a location 2A just outside the entrance 42 of the lower (or driller side) channel 46. The tubular 56 can move in direction 88 to location 2B, where the tubular 56 initially intersects the optical beams 72, 76 of the sensors 70, 74, respectively. It is preferred that the optical beams 72, 76 directly overlay each other, such that the tubular 56 will intersect both optical beams 72, 76 simultaneously.

When the tubular 56 first intersects (or interrupt) the optical beams 72, 76, the sensors 70, 74 can begin reporting sensor data of the interruption to the rig controller 90, where the sensor data can indicate a presence of the tubular 56 at the entrance 42. As the tubular 56 continues to travel in the direction 88, the sensors 70, 74 can communicate sensor data to the rig controller 90 on a real-time basis. The sensor data can include a time stamp for each time the sensor 70, 74 measures a parameter value (e.g. distance of an outside surface of the tubular 56 from the sensor 70, 74). For example, the sensors 70, 74 can measure the distance of the tubular 56 from the sensor 70, 74, respectively, and store the parameter values (along with other meta-data such as time stamps) in the sensors 70, 74 for later transmission to the rig controller 90, or the sensors 70, 74 can communicate the parameter values to the rig controller 90 in real time (e.g. one or more times a second).

Referring to FIG. 5B, the tubular 56 has moved in the direction 88 to location 2C, where the tubular 56 has shortened the distance between the tubular 56 and the sensors 70, 74. The optical sensor 70, 74 can continue to measure the distance (e.g. L1, L2; see FIGS. 5E and 5F) of the tubular 56 from the sensor 70, 74, respectively, as the tubular 56 passes through the entrance 42. Therefore, the rig controller 90 can analyze the sensor data from the sensors 70, 74 and create a plot of the sensor data vs. time (and vs. other parameters, such as L1 vs. L2). The plot can be used to determine various parameters of the tubular 56, when the tubular passes through the entrance 42. For example, if the tubular 56 is traveling along the center axis 182 of channel 46, then the distances L1 and L2 can be substantially equal. Variations between the distance L1 and the distance L2 can indicate that the tubular 56 is entering the entrance 42 at an angle from the center axis 182 or at least offset from the axis 182.

It may be preferable for the sensors 70, 74 to be positioned at an equal spacing away from the channel 46, which would allow the distance information measured by each sensor to be equal when the tubular 56 is centered in the channel 46. However, it should be understood that the sensors 70, 74 can be placed at different lengths from the channel 46. In this configuration, the rig controller 90 can know the distances L9, L10 the sensors 70, 74 are from the channel 46 and subtract that from the distance measurements L1, L2 to calculate distances L11, L12, respectively, where the distances L11, L12 represent a distance from the edge of the channel 46 to the tubular 56. If the sensors 70, 74 are placed at different lengths from the channel 46, then the discussion in this disclosure regarding distances L1, L2 can be applicable regarding distances L11, L12, respectively.

Referring to FIG. 5C, the tubular 56 has moved further in the direction 88 to location 2D, where the tubular 56 continues to intersect the optical beams 72, 76 of the sensors 70, 74, respectively. The sensor 70, 74 can continue to measure the distances L1, L2, respectively. The example shown in FIG. 5C illustrates the intersection of the optical beams 72, 76 when the tubular 56 enters the channel 46 through the entrance 42 along the center axis 182.

Referring to FIG. 5D, the tubular 56 has moved further in the direction 88 to location 2E, where the tubular 56 is no longer intersecting the optical beams 72, 76. As can be understood when viewing FIGS. 5A-5D, at some point as the tubular 56 passes through the entrance 42, the distances L1, L2 will be at their minimum values. The rig controller 90, when analyzing the sensor data from the sensor 70, 74, can determine the point that the distances L1, L2 are at their minimum and from that data, the rig controller 90 can determine a diameter D2 of the tubular 56, by knowing the distances between the sensors 70, 74 and the minimum distances L1, L2. Additionally, based on the calculated diameter D2, a speed of travel of the tubular 56 through the entrance 42 can also be calculated, since the rig controller 90 (from analyzing the sensor data from the sensor 70, 74) can determine a time period from when the tubular 56 first intersected the optical beams 72, 76, until the time when the tubular 56 no longer intersected the optical beams 72, 76. This time period along with the diameter D2 can be used to determine the speed of the tubular 56.

Therefore, the pair of sensors 70, 74 along with a rig controller 90 can be used to determine a diameter D2 of the tubular 56 that enters the channel 46. This can be used as a check or validation of the expected diameter of the tubular 56. If the actual diameter and the expected diameter do not match, the rig controller 90 can alert the operators, who can then take corrective action. It should be understood that the rig controller 90 can autonomously take corrective action, without operator involvement. Additionally, since the sensor data (which can include the distances L1, L2) can be time stamped, the rig controller 90 can determine (from analyzing the sensor data) the speed of the tubular 56 as it passes through the entrance 42. Furthermore, if the distances L1, L2 (or distances L11, L12 for non-symmetric positions of sensors 70, 74) remain substantially equal, then the rig controller 90 can determine that the tubular 56 has entered the channel 46 along the center axis 182. Conversely, if the distances L1, L2 (or distances L11, L12 for non-symmetric positions of sensors 70, 74) are not substantially equal, then the rig controller 90 can determine that the tubular 56 has entered the channel 46 at an angle A3 when compared to the center axis 182 or at least offset from the axis 182. This is described further below with regards to FIGS. 5E, 5F.

Referring to FIG. 5E, the tubular 56 has moved from location 2A to location 2E in the direction 88, where the tubular 56 has intersected the optical beams 72, 76. Respectively, the sensors 70, 74 can continue to measure the distances L1, L2. As can be seen, the distances L1, L2 are not substantially equal. With the tubular 56 at location 2E, the distance L1 is greater than the distance L2. The difference between the distances L1, L2 can be used to determine an angle A3 that indicates an offset of the direction of travel 88 from the center axis 182.

Similarly stated above regarding sensors 60, 62, this can be particularly beneficial when the tubular 56 is being removed from the fingerboard 40 and pushed toward the elevator 30 to be captured by the elevator 30. The angle A3 can indicate if the tubular 56 is correctly directed toward the elevator 30 and if there is a high level of probability that the tubular 56 will be correctly captured by the elevator 30. This direction of travel would be opposite the direction 88 shown in FIG. 5E, since the tubular 56 would be leaving the channel 46, through the entrance 42, and directed toward the elevator 30.

Even when the tubular 56 enters or exits the channel 46, the sensors 70, 74 and the rig controller 90 can be used to determine a presence of the tubular 56 at the entrance 42, a direction of travel 88 of the tubular 56, a diameter D2 of the tubular 56, a speed of the tubular 56 as it passes through the entrance 42, an angle offset A3 relative to the center axis 182 of the direction of travel 88 of the tubular 56, or combinations thereof.

Similar to FIG. 5E, FIG. 5F shows the tubular 56 moving from location 2A to location 2E in the direction 88, where the tubular 56 has intersected the optical beams 72, 76. Respectively, the sensors 70, 74 can continue to measure the distances L1, L2. As in FIG. 5E, the distances L1, L2 are not substantially equal. However, in FIG. 5F, the angle A3 is in an opposite direction than in FIG. 5E. With the tubular 56 at location 2E, the distance L1 is smaller than the distance L2. The difference between the distances L1, L2 can be used to determine an angle A3 that indicates an offset of the direction of travel 88 from the center axis 182.

Even when the tubular 56 enters or exits the channel 46 offset from the center axis 182, the sensors 70, 74 and the rig controller 90 can be used to determine a presence of the tubular 56 at the entrance 42, a direction of travel 88 of the tubular 56, a diameter D2 of the tubular 56, a speed of the tubular 56 as it passes through the entrance 42, an angle offset A3 relative to the center axis 182 of the direction of travel 88 of the tubular 56, or combinations thereof.

Figure 5G:
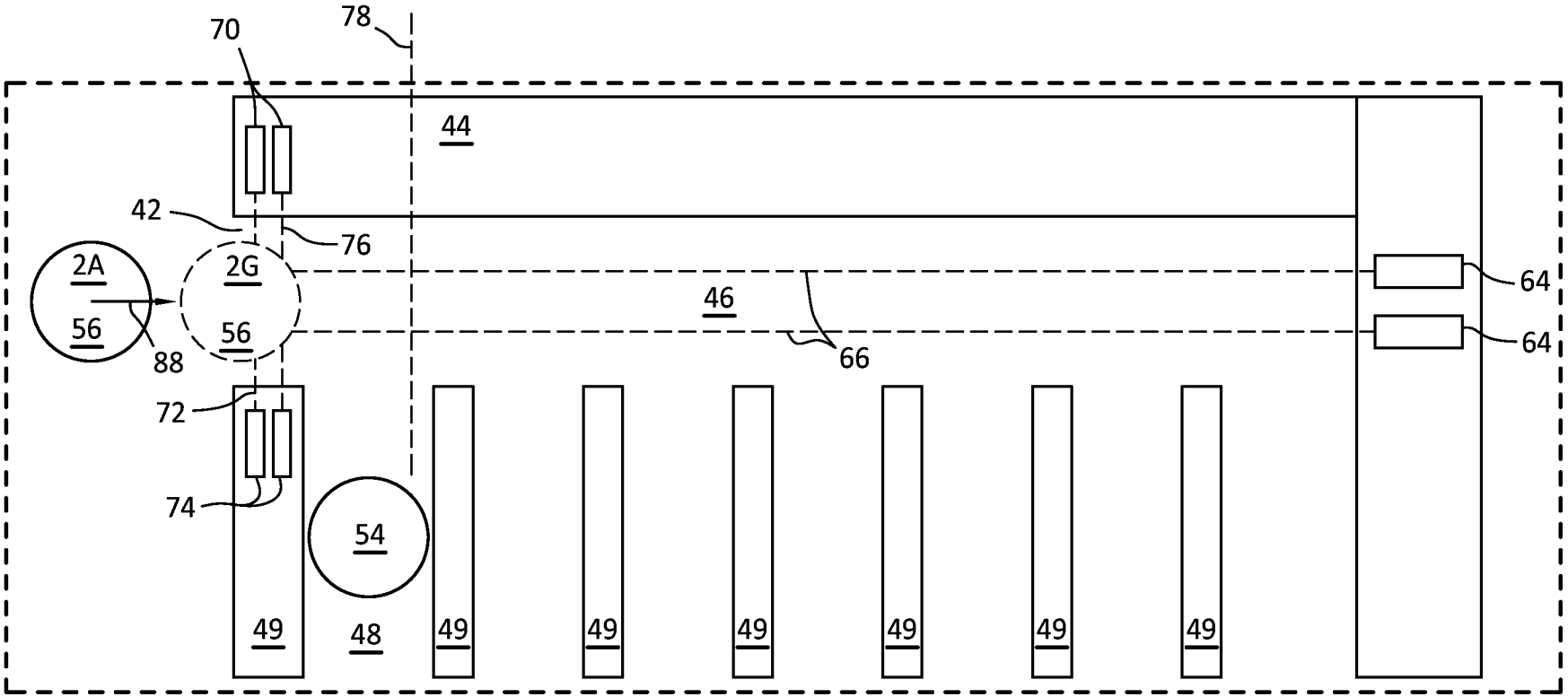
Figure 5H:
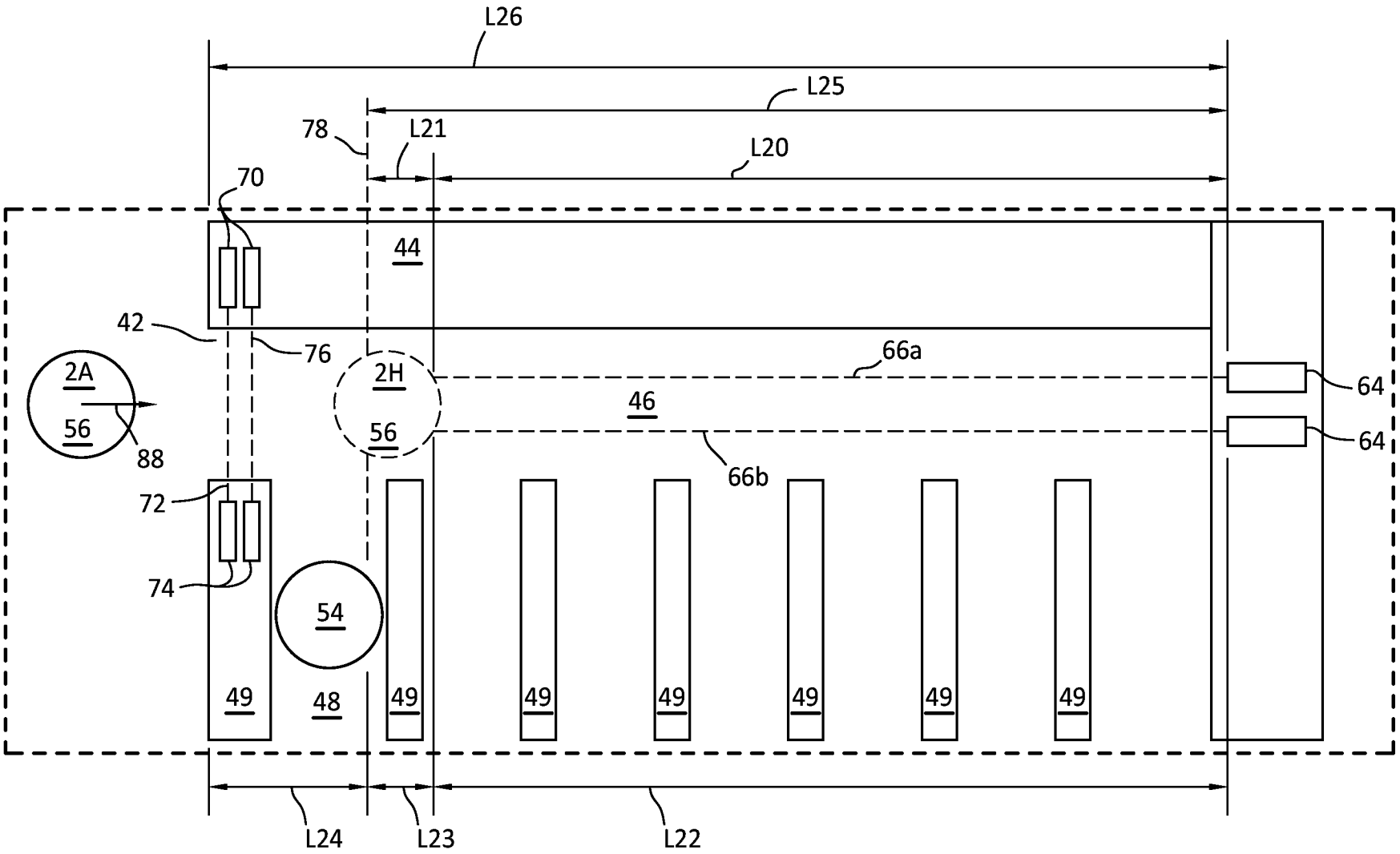

Operation of Pairs of Sensors 70, 74 and Sensors 64 with Reference to FIGS. 5G-5H.

Referring to FIG. 5G, another embodiment is provided that uses pairs of the sensors 70, 74 to detect direction of travel of the tubular in the fingerboard channel 46. FIGS. 5G-5H illustrate a tubular 56 entering the channel 46 through the entrance 42. However, it should be understood that the description of the sensors at the entrance 42 detecting a tubular 56 entering the channel 46 is similarly applicable to a tubular 56 passing through the entrance 42 as the tubular 56 exits the channel 46. Therefore, descriptions of determining speed through the entrance 42, direction through the entrance 42, angle of travel of the tubular 54 through the entrance 42 is similarly applicable to a tubular 56 entering the channel 46 or a tubular 56 exiting the channel 46.

When a tubular 56 is positioned at location 2A just outside the entrance 42 of a channel 46 and moves in direction 88 to location 2G, the optical signals 72, 76 created by the sensor pairs 70, 74 can provide an indication when each of the optical signals 72, 76 is crossed. The direction can be determined by detecting which optical signal 72, 76 was crossed first and which was crossed next. The first pair of sensors 70, 74 can produce an emitter-receiver relationship where one of the sensors 70, 74 emits an optical signal 72 and the other one of the sensors 70, 74 receives and detects the optical signal 72. The second pair of sensors 70, 74 can produce an emitter-receiver relationship where one of the sensors 70, 74 emits an optical signal 76 and the other one of the sensors 70, 74 receives and detects the optical signal 76.

When the optical signal 72, 76 is uninterrupted (i.e. not crossed) by the tubular 56, then the receiving sensor 70, 74 will detect an optical signal 72, 76. This can be indicated by outputting a low-level energy signal to the controller 90. When the optical signal 72, 76 is interrupted (i.e. crossed) by the tubular 56, then the receiving sensor 70, 74 will not detect an optical signal 72, 76. This can be indicated by outputting a high-level energy signal to the controller 90. Since the pairs of sensors 70, 74 can be spaced apart as shown in the FIG. 5G, one of the optical signals 72, 76 will be interrupted before the other optical signal when a tubular 56 is traveling into or out of the fingerboard channel 46. Because of the delay between when the optical signals 72, 76 are interrupted, the direction of travel of the tubular 56 can be determined.

The pairs of sensors 70, 74 can operate in quadrature, which means that the system will give no indication of the presence of a tubular 56 unless both pairs of sensors 70, 74 detect in interruption in the respective optical signal 72, 76 and there is an overlap in the detection of the interruptions. This can help prevent false positive indications from any non-tubular that might enter the channel 46 or a tubular 56 that enters the channel only enough to interrupt one of the optical signals 72, 76 and not both. This could indicate that the tubular 56 was redirected before interrupting both optical signals 72, 76.

Referring to FIG. 5H, a tubular 56 can move from position 2A to position 2H inside the channel 46. Sensors 64 can be used to measure a distance L20, L22 from the tubular 56 to the respective sensor 64 at the back of the channel 46 as soon as the pair of sensors 70, 74 indicate a tubular 56 has entered the channel 46. Once the tubular has crossed the optical signals 72, 76, it can still be at risk of being contacted by the top drive 18 until it has reached a minimum safe distance 78 inside the channel 46 as determined by the measurements from the sensors 64 at the back of the channel 46. The minimum safe distance 78 can vary depending on the type of equipment being utilized in the operation. For example, different diameter tubulars can cause the minimum safe distance 78 to vary.

As the tubular 56 enters the channel 46 it can sequentially interrupt the optical signals 72, 76. The distance L20 indicates the distance measurement of one sensor 64 that outputs an optical signal 66*a* and detects the tubular 56 when the tubular 56 interrupts the optical signal 66*a*. The distance L22 indicates the distance measurement of one sensor 64 that outputs an optical signal 66*b* and detects the tubular 56 when the tubular 56 interrupts the optical signal 66*b*. The distances L20 and L22 can be the same or different depending upon the position of the tubular 56 in the channel 46. If one or both of the distances L20, L22 are equal to or less than the minimum safe distance 78, then the top drive 18 can be released to move down toward the drill floor 16.

The minimum safe distance 78 can be defined as the distance L25 from the sensors 66 at the rear of the channel 46. In this approach, the controller 90 can compare the distances L20 and L22 to determine the position of the tubular 56 relative to the minimum safe distance 78. If the tubular 56 is in an acceptable position relative to the minimum safe distance 78, the controller 90 can indicate that the top drive 18 can be released.

Alternatively, or in addition to, the minimum safe distance 78 can be defined as the distance L24 from the front of the fingerboard 40 at the entrance 42 of the channel 46. If L24 defines the minimum safe distance 78, then the controller 90 can be used to calculate the distance of the tubular 56 from the entrance 42 and compare it to L24. For example, the controller 90 can subtract the distance L20 from the overall distance L26 from the entrance 42 to the sensors 66.

The distance L21 indicates the distance between the measured position of the tubular 56 by the optical signal 66*a* and the minimum safe distance 78. The distance L21 can be negative (closer to the entrance 42) or positive (closer to the sensors 64) depending on the position of the measured position of the tubular 56 relative to the minimum safe distance 78.

The distance L23 indicates the distance between the measured position of the tubular 56 by the optical signal 66*b* and the minimum safe distance 78. The distance L23 can be negative (closer to the entrance 42) or positive (closer to the sensors 64) depending on the position of the measured position of the tubular 56 relative to the minimum safe distance 78.

When a tubular 56 crosses the laser paths 72, 76, an indication can be given to the controller 90 to hold the top drive 18 in place until the tubular 56 has reached the minimum safe distance 78 in the channel 46. If the tubular 56 is positioned in a channel 48 between the fingers 49 that is before the minimum safe distance 78, sensor pairs 70, 74 can detect the entrance of the tubular 56 into the channel and the sensors 64 can detect the absence of the tubular 56 in the channel 46, which can indicate to the controller 90 that the tubular 56 has been positioned in a storage location (e.g. 54) in a channel 48 that is before the minimum safe distance 78, and the controller 90 can indicate (or initiate) a release of the top drive 18.

Figure 6A:
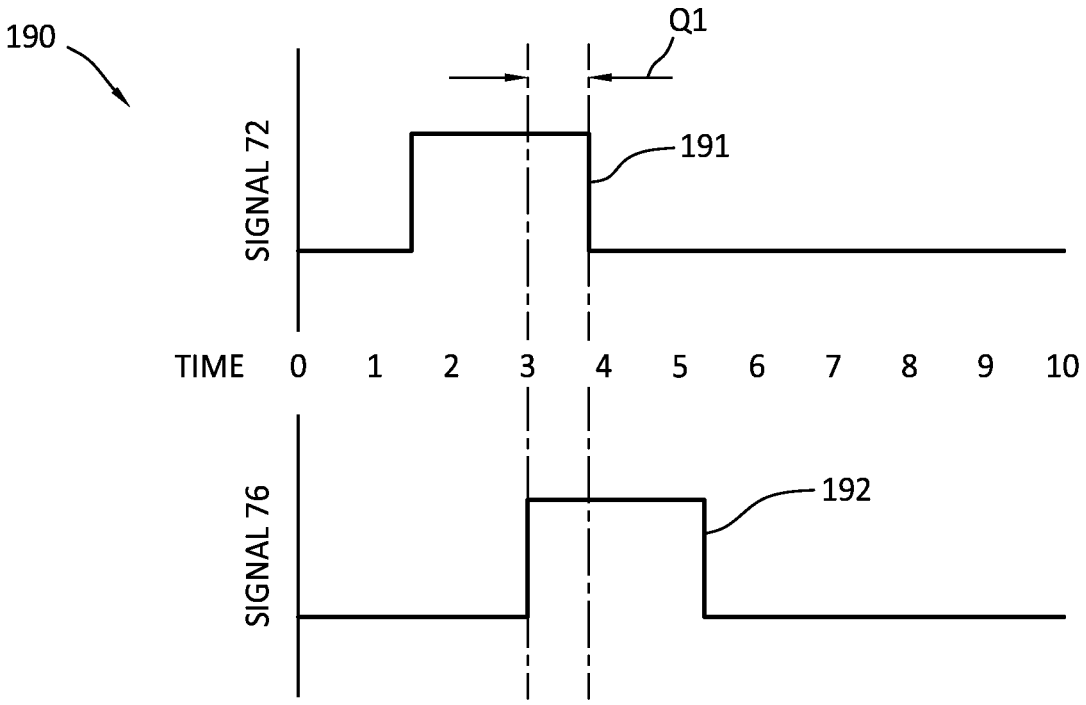
FIGS. 6A-6B are representative plots of optical sensors vs. time, in accordance with certain embodiments.

Referring to FIG. 6A, the plot 190 indicates representative plots 191, 192 of the signals 72, 76, respectively, that can be emitted by sensor pairs 70, 74 when a tubular 56 crosses the optical signals 72, 76. As stated above, the low-level energy output from the detecting sensor of the sensor pair 70, 74 can indicate that respective optical signal 72, 76 is not been interrupted, and a high-level output from the detecting sensor of the sensor pair 70, 74 can indicate that respective optical signal 72, 76 has been interrupted. It should be understood that the low-level energy output can indicate the optical signal 72, 76 has been interrupted and the high-level energy output can indicate the optical signal 72, 76 has not been interrupted. It should be understood that the transition from one level to the other is the desired indicator of a presence of the tubular 56 in the channel 46. The time indicators shown on the X-axis of the plots 191, 192 can represent any time value, such as milliseconds, seconds, etc.

The plot 191 indicates that the first sensor pair 70, 74, which outputs and receives the optical signal 72, detects a signal interruption at time ~1.5 that lasts until time ~3.8, which indicates a presence of a tubular 56 between the first sensor pair 70, 74 during that time period. The plot 192 indicates that the second sensor pair 70, 74, which outputs and receives the optical signal 76, detects a signal interruption at time ~3.0 that lasts until time ~5.3, which indicates a presence of a tubular 56 between the second sensor pair 70, 74 during that time period. The positive indication time periods of plots 191, 192 overlap each other by a time Q1, which can be referred to as a quadrature. The controller 90 can determine that time span of the quadrature Q1 and use that span to determine if the tubular 56 actually entered the channel 46 or if the plots indicate a false positive (which can occur when only one of the plots 191, 192 indicates a presence of a tubular 56). If the controller 90 determines that the tubular 56 has entered the channel 46, then the controller 90 can use the sensors 64 to determine the position of the tubular 56 in the channel 46. Additionally, the controller 90 can determine from comparing the plots 191, 192 that the tubular 56 has entered the channel 46, since the optical signal 72 is interrupted first and the optical signal 76 is interrupted next.

Figure 6B:
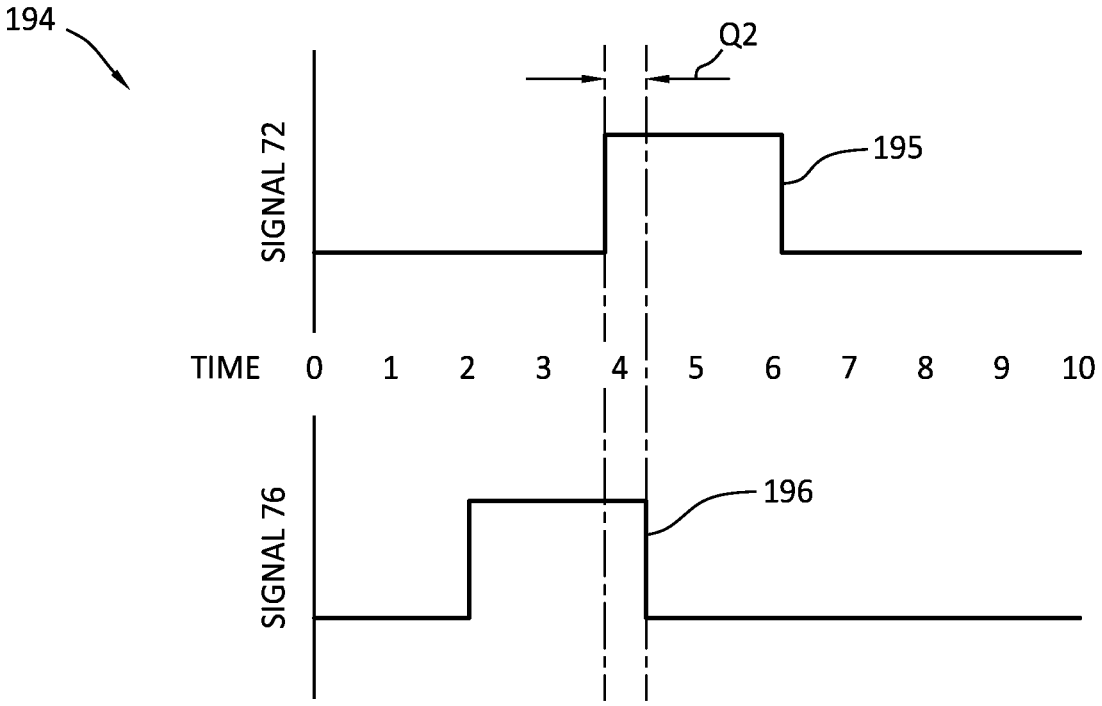

Referring to FIG. 6B, the plot 194 indicates representative plots 195, 196 of the signals 72, 76, respectively, that can be emitted by sensor pairs 70, 74 when a tubular 56 crosses the optical signals 72, 76. As stated above, the low-level energy output from the detecting sensor of the sensor pair 70, 74 can indicate that respective optical signal 72, 76 is not been interrupted, and a high-level output from the detecting sensor of the sensor pair 70, 74 can indicate that respective optical signal 72, 76 has been interrupted. The time indicators shown on the X-axis of the plots 195, 196 can represent any time value, such as milliseconds, seconds, etc.

The plot 191 indicates that the first sensor pair 70, 74, which outputs and receives the optical signal 72, detects a signal interruption at time ~3.9 that lasts until time ~6.2, which indicates a presence of a tubular 56 between the first sensor pair 70, 74 during that time period. The plot 192 indicates that the second sensor pair 70, 74, which outputs and receives the optical signal 76, detects a signal interruption at time ~2.0 that lasts until time ~4.3, which indicates a presence of a tubular 56 between the second sensor pair 70, 74 during that time period. The positive indication time periods of plots 195, 196 overlap each other by a time Q2, which can be referred to as a quadrature. The controller 90 can determine that time span of the quadrature Q2 and use that span to determine if the tubular 56 actually exited the channel 46 or if the plots indicate a false positive (which can occur when only one of the plots 195, 196 indicates a presence of a tubular 56). If the controller 90 determines that the tubular 56 has exited the channel 46, then the controller 90 communicate this event to another controller or an operator. Additionally, the controller 90 can determine from comparing the plots 195, 196 that the tubular 56 has exited the channel 46, since the optical signal 76 is interrupted first and the optical signal 72 is interrupted next.

Figure 7A:
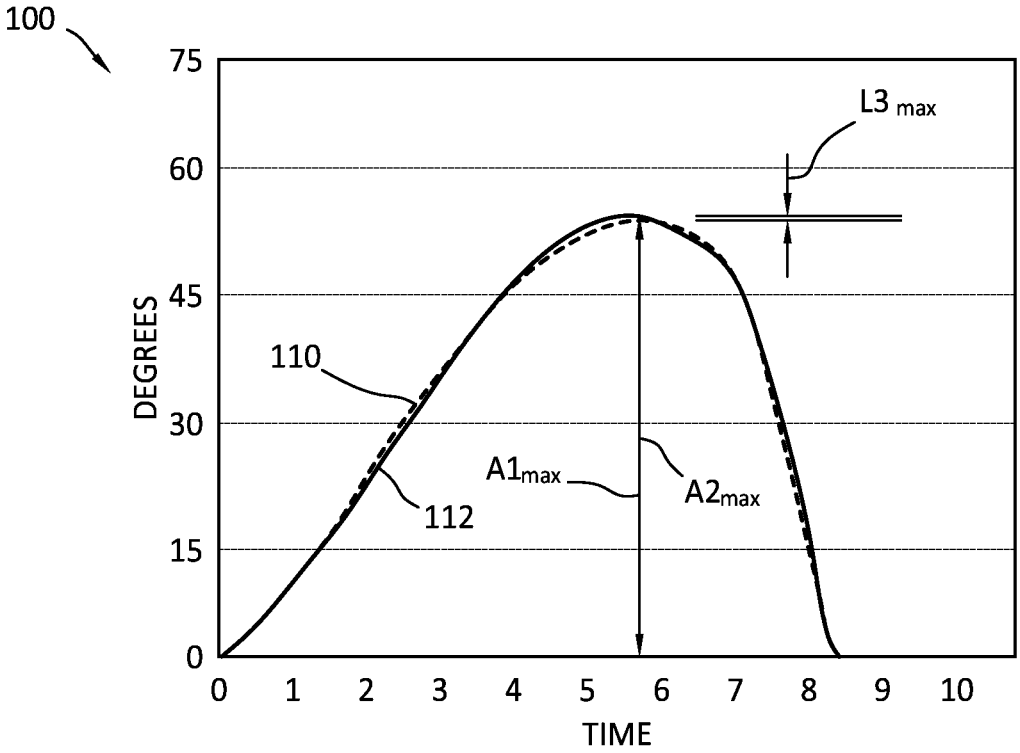
FIGS. 7A-7B are representative plots of rotation sensors vs. time, in accordance with certain embodiments.

FIG. 7A represents an example plot 100 of the angles A1, A2 of the sensors 60, 62 of FIGS. 5A-5F as a function of time as a tubular 56 enters or exits the channel 46 through the entrance 42. The time indicators shown on the X-axis of the plot 100 can represent any time value, such as milliseconds, seconds, etc. This plot illustrates the plot of the angles A1, A2 over a period of time that it takes for the tubular 56 to enter or exit the channel 46. In this example, the line 110 represents the angle A1 plotted as a function of time, and line 112 represents the angle A2 plotted as a function of time. Any point in time under the lines 110, 112 can be used to indicate a presence of the tubular 56 at the entrance 42.

As can be seen by lines 110, 112, the angles A1, A2 remain substantially equal as the tubular 56 moves through the entrance 42. Difference L3 refers to a difference between the angle A1 and the angle A2 at a particular point in time. With difference L3 being substantially "zero", this can indicate that the tubular 56 is entering or exiting the channel 46 along the axis 180 and centered in the channel 46. Additionally, the maximum values A1*max* and A2*max* can be used by the rig controller 90 to determine the diameter D1 of the tubular 56. With the diameter D1 known, the rig controller 90 can determine the speed of the tubular 56 as it travels through the entrance 42. The maximum difference between the angle A1 and the angle A2 can be used to define a point in time that the rig controller 90 can use to calculate the diameter D1 of the tubular 56. The rig controller 90 can retrieve the angle A1 and angle A2 at that point in time where the difference L3 is greatest, and use those values of angles A1, A2 at that point in time to calculate the diameter D1 of the tubular 56.

Figure 7B:
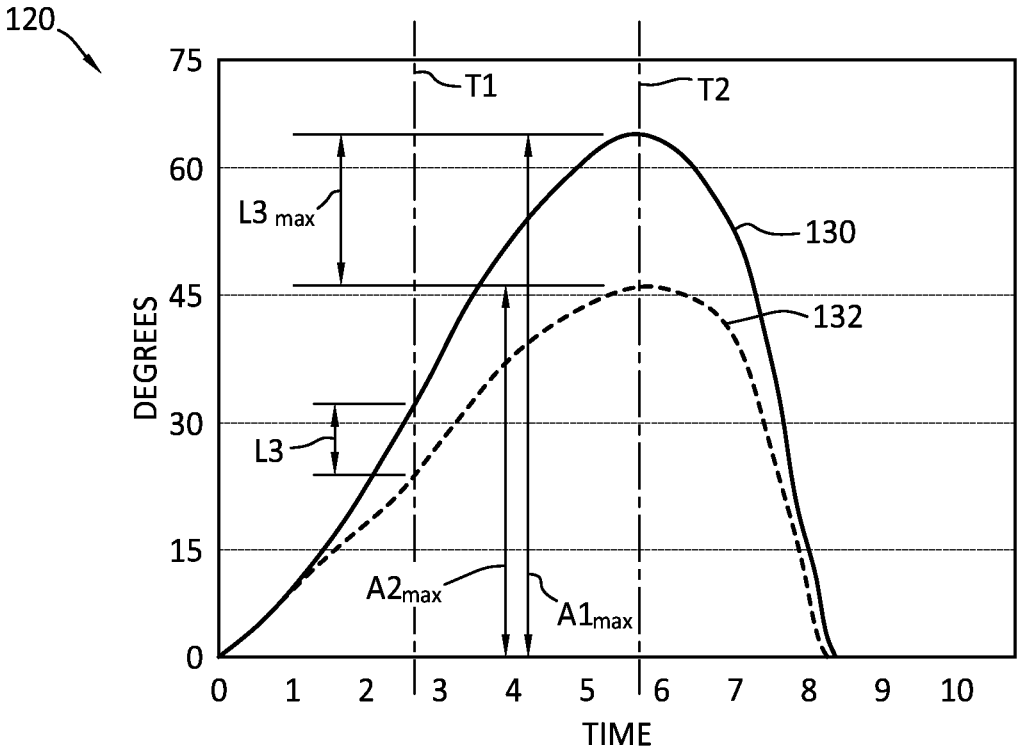

FIG. 7B represents an example plot 120 of the angles A1, A2 of the sensors 60, 62 of FIGS. 5A-5F as a function of time as a tubular 56 enters or exits the channel 46 through the entrance 42. The time indicators shown on the X-axis of the plot 120 can represent any time value, such as milliseconds, seconds, etc. This plot illustrates the plot of the angles A1, A2 over a period of time that it takes for the tubular 56 to enter or exit the channel 46. In this example, the line 130 represents the angle A1 plotted as a function of time, and line 132 represents the angle A2 plotted as a function of time. Any point in time under the lines 130, 132 can be used to indicate a presence of the tubular 56 at the entrance 42.

As can be seen by lines 130, 132, the angles A1, A2 are substantially not equal as the tubular 56 moves through the entrance 42. Difference L3 refers to a difference between the angle A1 and the angle A2 at a particular point in time (e.g. time T1). With difference L3 being substantially "non-zero", this can indicate that the tubular 56 is entering or exiting the channel 46 offset from the axis 180 or not centered in the channel 46. Additionally, the maximum values A1*max* and A2*max* can be used by the rig controller 90 to determine the diameter D1 of the tubular 56. With the diameter D1 known, the rig controller 90 can determine the speed of the tubular 56 as it travels through the entrance 42. The maximum difference L3 between the angle A1 and the angle A2 can be used to define the point in time T2 the rig controller 90 can use to calculate the diameter D1 of the tubular 56. The rig controller 90 can retrieve the angle A1 and angle A2 at the point in time T2 that the difference L3 is greatest (i.e. L3*max*), and use the values of angles A1, A2 at time T2 to calculate the diameter D1 of the tubular 56. In plot 120, the difference L3*max* is shown to be approximately 16 degrees.

When the tubular 56 is first detected at the entrance 42, the sensors 60, 62 can communicate the detection to the rig controller 90, which can control the top drive 18 directly to allow the top drive 18 to begin its descent to engage with the tubular string 58 to repeat the process of removing a tubular 56 from the tubular string 58. This can ensure that the tubular 56 is clear of the path of the top drive 18 when it descends to the drill floor 16. The rig controller 90 can also communicate via a Graphical User Interface (GUI) to an operator that the tubular 56 is clear and the top drive 18 can be lowered via operator control.

Figure 8A:
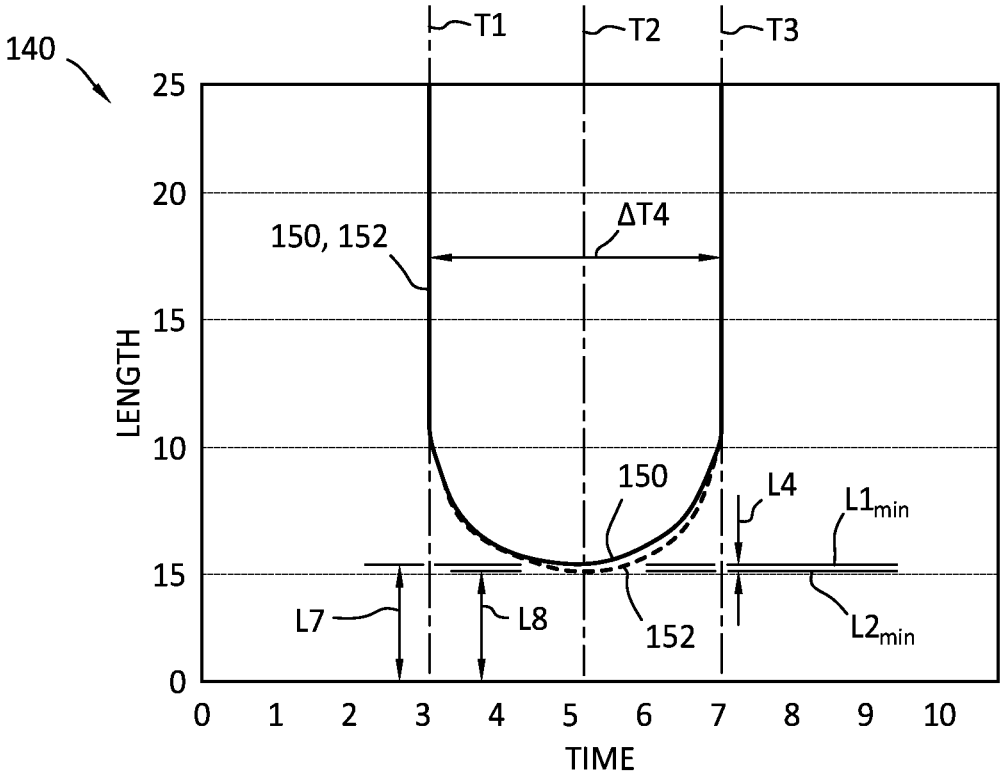
FIGS. 8A-8B are representative plots of distance sensors vs. time, in accordance with certain embodiments.

FIG. 8A represents an example plot 140 of the distances L1, L2 related to sensors 70, 74 of FIGS. 5A-5F as a function of time as a tubular 56 enters or exits the channel 46 through the entrance 42. The time indicators shown on the X-axis of the plot 100 can represent any time value, such as milliseconds, seconds, etc. This plot illustrates the plot of the distances L1, L2 over a period of time that it takes for the tubular 56 to enter or exit the channel 46. In this example, the line 150 represents the distance L1 plotted as a function of time, and line 152 represents the distance L2 plotted as a function of time. Any point in time under the lines 150, 152 can be used to indicate a presence of the tubular 56 at the entrance 42.

Since the sensors 70, 74 detect objects that intersect the optical beams 72, 76, respectively, the distances L1, L2 measured by the sensors 70, 74 when an object is not intersecting the optical beams 72, 76, respectively, can be long, if they detect an object at all. Therefore, until the tubular 56 intersects the optical beams 72, 76, the distances L1, L2 can be off the chart. When the tubular 56 begins to intersect the optical beams 72, 76, the distances L1, L2 can appear as a vertical line at the beginning (e.g. time T1) and end (e.g. time T3) of the tubular 56 as the tubular 56 passes through the optical beams 72, 76.

Figure 8B:
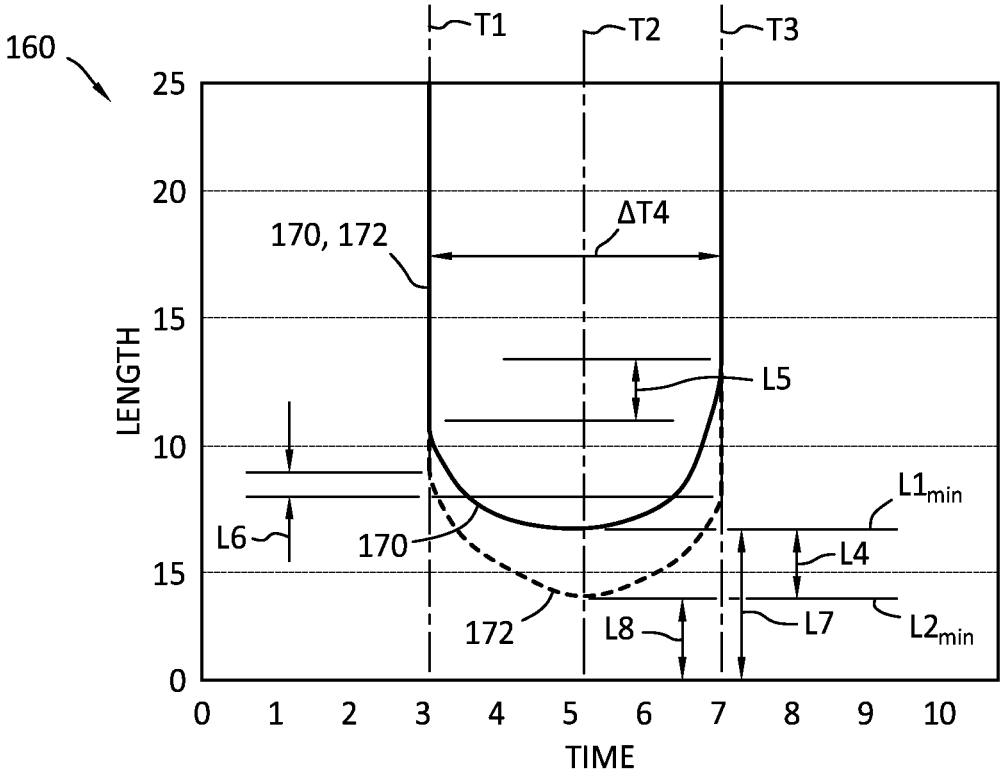

As the tubular 56 passes through the optical beams 72, 76, the sensors 70, 74 can detect the tubular 56 and the distances L1, L2 can change due to the circular shape of the tubular 56. Therefore, the shortest of the distances L1, L2 (i.e. $L1_{min}$ and $L2_{min}$) can indicate the crest of the circular shape of the tubular 56. FIGS. 8A and 8B indicate that distance L7 equals $L1_{min}$ and distance L8 equals $L2_{min}$. Therefore, with the rig controller 90 knowing the distance between the sensors 70, 74, the diameter D2 of the tubular 56 can be calculated by subtracting the distances $L1_{min}$ and $L2_{min}$ (or distances L7, L8) from the known distance between the sensors 70, 74.

The maximum difference between the distances L1, L2 or the distances $L1_{min}$ and $L2_{min}$ can be used to define the point in time (e.g. time T2) that the rig controller 90 can use to calculate the diameter D2 of the tubular 56. The rig controller 90 can retrieve the distances L1, L2 at the point in time T2 that the difference L4 is greatest, and use these distances L1, L2 to calculate the diameter D2 of the tubular 56. The rig controller 90 can also use the distances $L1_{min}$ and $L2_{min}$ to calculate the diameter D2 of the tubular 56.

As can be seen, the distances L1, L2 remain substantially equal as the tubular 56 moves through the entrance 42. Difference L4 refers to a difference between the distance L1 and the distance L2 at a particular point in time. With difference L4 being substantially "zero", this can indicate that the tubular 56 is entering or exiting the channel 46 along the axis 182 and centered in the channel 46. With the diameter D2 known, the rig controller 90 can determine the speed of the tubular 56 as it travels through the entrance 42.

FIG. 8B represents an example plot 160 of the distances L1, L2 related to sensors 70, 74 of FIGS. 5A-5F as a function of time as a tubular 56 enters or exits the channel 46 through the entrance 42. The time indicators shown on the X-axis of the plot 160 can represent any time value, such as milliseconds, seconds, etc. This plot 160 illustrates the plot of the distances L1, L2 over a period of time that it takes for the tubular 56 to enter or exit the channel 46. In this example, the line 170 represents the distance L1 plotted as a function of time, and line 172 represents the distance L2 plotted as a function of time. Any point in time under the lines 170, 172 can be used to indicate a presence of the tubular 56 at the entrance 42.

As can be seen, the distances L1, L2 are substantially not equal as the tubular 56 moves through the entrance 42. Difference L4 refers to a difference between the distance L1 and the distance L2 at a particular point in time (e.g. time T1, T2, or T3). With difference L4 being substantially "non-zero", this can indicate that the tubular 56 is entering or exiting the channel 46 offset from the axis 182 and not centered in the channel 46. Additionally, the minimum values $L1_{min}$ and $L2_{min}$ can be used by the rig controller 90 to determine the diameter D2 of the tubular 56 as described above. With the diameter D2 known, the rig controller 90 can determine the speed of the tubular 56 as it travels through the entrance 42.

The maximum difference L4 between the distances L1, L2 or the distances $L1_{min}$ and $L2_{min}$ can be used to define the point in time T2 the rig controller 90 can use to calculate the diameter D2 of the tubular 56. The rig controller 90 can retrieve the distances L1, L2 at the point in time that the difference L4 is greatest, and use those values of the distances L1, L2 at that point in time to calculate the diameter D2 of the tubular 56. The rig controller 90 can also use the distances $L1_{min}$ and $L2_{min}$ to calculate the diameter D2 of the tubular 56.

Additionally, the lines 170, 172 can be used by the rig controller 90 to determine an angle offset A3 from the axis 182 the tubular 56 is traveling into or out of the channel 46. The difference L5 defines a difference between the distance measurement taken for distance L1 at time T1 and the distance measurement taken for distance L1 at time T3. The difference L5, along with the calculated (or expected) diameter D2 of the tubular 56, can be used by the rig controller 90 to determine a direction 88 and how the direction 88 compares to the center axis 182 of the channel 46. The difference L6 defines a difference between the distance measurement taken for distance L2 at time T1 and the distance measurement taken for distance L2 at time T3. The difference L6, along with the calculated (or expected) diameter D2 of the tubular 56, can be used by the rig controller 90 to determine a direction 88 and how the direction 88 compares to the center axis 182 of the channel 46. The rig controller 90 can use both the differences L5, L6 to improve the calculation accuracy.

When the tubular 56 is first detected at the entrance 42, the sensors 70, 74 can communicate the detection to the rig controller 90, which can control the top drive directly to allow the top drive 18 to begin its descent to engage with the tubular string 58 to repeat the process of removing a tubular 56 from the tubular string 58. This can ensure that the tubular 56 is clear of the path of the top drive 18 when it descends to the drill floor 16. The rig controller 90 can also communicate via a Graphical User Interface (GUI) to an operator that the tubular 56 is clear and the top drive 18 can be lowered via operator control.

Figure 9:
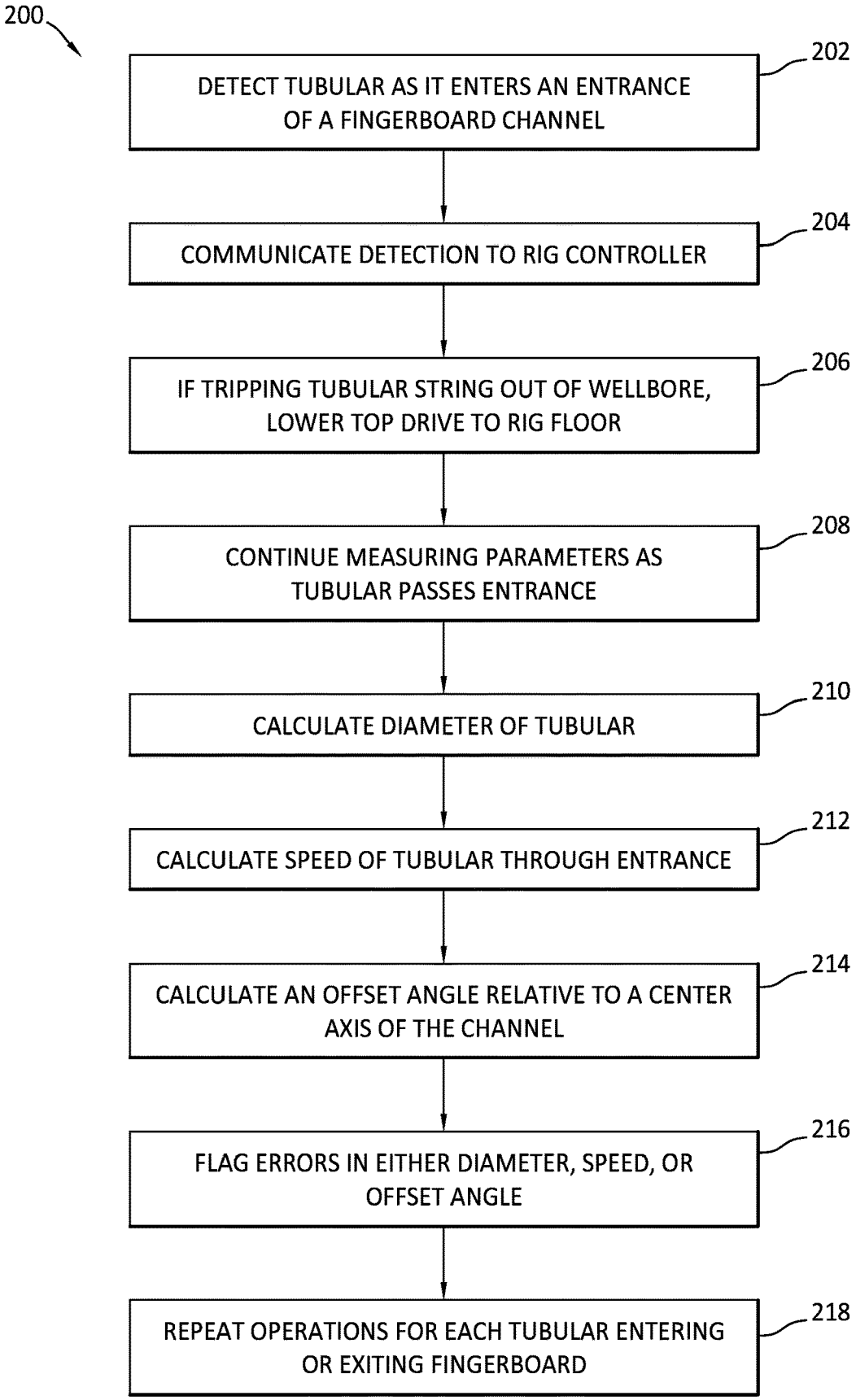
FIG. 9 is a representative flow chart of a method for detecting entrance of a tubular into or exit of a tubular from a fingerboard on a rig, in accordance with certain embodiments.

FIG. 9 is a representative flow chart of the method 200 for detecting a tubular 56 at an entrance 42 to a fingerboard 40. In operation 202, sensors 60, 62 or 70, 74, 64 positioned on opposite sides of the channel 46 of the fingerboard 40 at an entrance 42 of the channel 46 can detect when a tubular 56 begins to pass through the entrance 42. In operation 204, this detection can be communicated to a rig controller 90. In operation 206, if a tubular string 58 is being tripped out of the wellbore 15, then the rig controller 90 can begin descent of the top drive 18 toward the drill floor 16 or the rig controller 90 can alert an operator that it is safe to begin lowering the top drive 18. In operation 208, as the tubular 56 continues to pass through the entrance 42 of the channel 46, the sensors 60, 62 or sensors 70, 74 can continue to measure the tubular 56. When the tubular 56 has passed the entrance 42, the sensor data communicated to the rig controller 90 by the sensors 60, 62 or 70, 74, 64 can be used to calculate a diameter D1, D2 of the tubular 56 in operation 210, calculate a speed of the tubular 56 when it passed through the entrance 42 in operation 212, or calculate an offset angle relative to a center axis 180, 182 of the travel direction 86, 88 of the tubular 56 as it passed through the entrance 42 in operation 214. In operation 216, the rig controller 90 can compare the diameter, speed, or travel direction offset against expected values for the diameter, speed, and travel direction offset. If any are outside acceptable value ranges, then the rig controller 90 can initiate corrective action or communicate the errors to the operators for corrective action.

Various Embodiments

Embodiment 1. A system for conducting a subterranean operation, the system comprising:

a rig;

a fingerboard on the rig, the fingerboard having an entrance and a plurality of tubular storage locations; and a first sensor and a second sensor, with the first sensor positioned on an opposite side of the entrance from the second sensor, with the first sensor and the second sensor being configured to detect when a tubular enters or exits the fingerboard and configured to detect a parameter of the tubular as the tubular enters or exits the fingerboard.

Embodiment 2. The system of embodiment 1, wherein the parameter is selected from a group consisting of a presence of the tubular, a direction of travel of the tubular, a diameter of the tubular, a speed of the tubular as it passes through the entrance, an angle offset of the direction of travel of the tubular, or combinations thereof.

Embodiment 3. The system of embodiment 1, wherein the first sensor comprises a first encoder and a first arm, and wherein the first encoder detects rotation of the first arm about a first axis of the first sensor.

Embodiment 4. The system of embodiment 3, wherein the second sensor comprises a second encoder and a second arm, and wherein the second encoder detects rotation of the second arm about a second axis of the second sensor.

Embodiment 5. The system of embodiment 4, wherein the first encoder detects a first arc length of the first arm when the first arm is rotated from a first initial position to a first rotated position, and wherein the second encoder detects a second arc length of the second arm when the second arm is rotated from a second initial position to a second rotated position.

Embodiment 6. The system of embodiment 5, wherein the first arm is rotated to the first rotated position and the second arm is rotated to the second rotated position when the tubular contacts the first arm and the second arm as the tubular passes through the entrance.

Embodiment 7. The system of embodiment 6, further comprising a rig controller that is configured to determine a diameter of the tubular by comparing the first rotated position with the second rotated position.

Embodiment 8. The system of embodiment 7, wherein the rig controller is configured to determine a speed of the tubular passing through the entrance based on the diameter of the tubular and sensor data received by the rig controller from the first sensor and the second sensor.

Embodiment 9. The system of embodiment 8, wherein the sensor data contains a time stamp for each set of sensor data received by the rig controller from the first sensor and the second sensor.

Embodiment 10. The system of embodiment 5, further comprising a rig controller that is configured to compare the first arc length with the second arc length and determine an angle of tubular entry into or tubular exit from the fingerboard.

Embodiment 11. The system of embodiment 10, wherein the rig controller is configured to log a first plot of the first arc length vs. time and log a second plot of the second arc length vs. time, and wherein the rig controller is configured to determine the angle of tubular entry into or tubular exit from the fingerboard based on the first plot and the second plot.

Embodiment 12. The system of embodiment 11, wherein the rig controller is configured to compare the first plot to the second plot, and the angle is determined based on the comparison of the first plot to the second plot.

Embodiment 13. The system of embodiment 1, wherein the first sensor and the second sensor are optical sensors that detect a presence of the tubular when the tubular intersects an optical beam from either one of the optical sensors.

Embodiment 14. The system of embodiment 13, further comprising a rig controller that is configured to log a first plot of a first distance of the tubular from the first sensor vs. time as the tubular moves through the entrance of the fingerboard, and log a second plot of a second distance of the tubular from the second sensor vs. time as the tubular moves through the entrance of the fingerboard.

Embodiment 15. The system of embodiment 14, wherein the rig controller is configured to determine a diameter of the tubular based on the first plot and the second plot.

Embodiment 16. The system of embodiment 14, wherein the rig controller is configured to determine the angle the tubular enters or exits the fingerboard and a speed the tubular enters or exits the fingerboard based on the first plot and the second plot, and a diameter of the tubular.

Embodiment 17. The system of embodiment 1, further comprising one or more third sensors positioned at an end of a channel of the fingerboard and directed toward the entrance, with the entrance disposed at an opposite end of the channel.

Embodiment 18. The system of embodiment 17, wherein the third sensors are optical sensors with optical beams directed toward the entrance, and wherein the third sensors detect when a tubular is present in the channel based on when the tubular intersects one or more of the optical beams of the third sensors.

Embodiment 19. A system for conducting a subterranean operation, the system comprising:

a rig;

a top drive configured to lift and lower a tubular string in a wellbore;

a fingerboard on the rig, the fingerboard having an entrance and a plurality of tubular storage locations; and a first sensor and a second sensor, with the first sensor positioned on an opposite side of the entrance from the second sensor, wherein the first sensor and the second sensor detect when a tubular passes an entrance of the fingerboard, and wherein movement of the top drive is halted until either one of the first sensor and the second sensor detect the tubular.

Embodiment 20. The system of embodiment 19, further comprising a rig controller that is configured to receive an indication of the detection of the tubular from the first sensor and the second sensor, and wherein the rig controller enables the movement of the top drive based on reception of the indication.

Embodiment 21. The system of embodiment 19, further comprising a rig controller that is configured to receive sensor data from the first sensor and the second sensor, and plot the sensor data vs. time, wherein the rig controller is configured to determine a parameter of the tubular based on the plot of the sensor data.

Embodiment 22. The system of embodiment 21, wherein the parameter is selected from a group consisting of a presence of the tubular, a direction of travel of the tubular, a diameter of the tubular, a speed of the tubular as it passes through the entrance, an angle offset of the direction of travel of the tubular, or combinations thereof.

Embodiment 23. The system of embodiment 21, wherein the first sensor comprises a first encoder and a first arm, wherein the first encoder detects rotation of the first arm about a first axis of the first sensor, wherein the second sensor comprises a second encoder and a second arm, and wherein the second encoder detects rotation of the second arm about a second axis of the second sensor.

Embodiment 24. The system of embodiment 21, wherein the first sensor and the second sensor are optical sensors that detect a presence of the tubular when the tubular intersects an optical beam from either one of the optical sensors.

Embodiment 25. A method for conducting a subterranean operation, the method comprising:

sensing, via first and second sensors, when a tubular is entering a fingerboard through an entrance of the fingerboard;

restricting movement of a top drive at an elevated position until the first and second sensors sense the tubular entering the fingerboard; and enabling movement of the top drive when the first and second sensors sense the tubular entering the fingerboard.

Embodiment 26. The method of embodiment 25, wherein enabling the movement of the top drive comprises communicating to a rig controller when the first and second sensors sense the tubular entering the fingerboard; and alerting an operator, via the rig controller, to initiate movement of the top drive toward a drill floor.

Embodiment 27. The method of embodiment 25, wherein enabling the movement of the top drive comprises communicating to a rig controller when the first and second sensors sense the tubular entering the fingerboard; and initiating, via the rig controller, movement of the top drive toward a drill floor after the tubular begins to enter the fingerboard.

Embodiment 28. The method of embodiment 25, further comprising:

transmitting sensor data from the first and second sensors to a rig controller;

plotting the sensor data vs. time, thereby creating a first plot of sensor data from the first sensor and a second plot of sensor data from the second sensor;

comparing the first plot to the second plot; and determining a parameter of the tubular based on the comparing.

Embodiment 29. The method of embodiment 28, wherein the parameter is selected from a group consisting of a presence of the tubular, a direction of travel of the tubular, a diameter of the tubular, a speed of the tubular as it passes through the entrance, an angle offset of the direction of travel of the tubular, or combinations thereof.

Embodiment 30. The method of embodiment 28, wherein the first sensor comprises a first encoder and a first arm, wherein the first encoder detects rotation of the first arm about a first axis of the first sensor, wherein the second sensor comprises a second encoder and a second arm, and wherein the second encoder detects rotation of the second arm about a second axis of the second sensor.

Embodiment 31. The method of embodiment 30, further comprising:

determining, via the rig controller, a maximum rotation of the first arm and a maximum rotation of the second arm; and determining, via the rig controller, a diameter of the tubular based on a known length of the first arm and the second arm, the maximum rotation the first arm and the second arm, and a known distance between the first sensor and the second sensor.

Embodiment 32. The method of embodiment 31, further comprising:

determining, via the rig controller, a speed of the tubular as the tubular passes through an entrance of the fingerboard based on the diameter of the tubular, the first plot, and the second plot.

Embodiment 33. The method of embodiment 30, further comprising:

determining, via the rig controller, an angle offset of a travel direction of the tubular as the tubular enters a channel of the fingerboard, wherein the angle offset of the travel direction is relative to a center axis of the channel.

Embodiment 34. A system for conducting a subterranean operation, the system comprising:

a rig;

a top drive configured to lift and lower a tubular string in a wellbore;

a fingerboard on the rig, the fingerboard having an entrance and a plurality of tubular storage locations;

a first pair of sensors comprising a first sensor and a second sensor, with the first sensor positioned on an opposite side of the entrance from the second sensor, wherein the first sensor and the second sensor detect when a tubular passes an entrance of a channel of the fingerboard; and a second pair of sensors comprising a third sensor and a fourth sensor, with the third sensor positioned on an opposite side of the entrance from the fourth sensor, wherein the third sensor and the fourth sensor detect when the tubular passes an entrance of the fingerboard, and wherein movement of the top drive is halted until either one of the first pair of sensors and the second pair of sensors detect the tubular.

Embodiment 35. The system of embodiment 34, further comprising a rig controller that is configured to receive an indication of the detection of the tubular from the first pair of sensors and the second pair of sensors, and wherein the rig controller enables the movement of the top drive based on reception of the indication.

Embodiment 36. The system of embodiment 34, further comprising a rig controller that is configured to receive sensor data from the first pair of sensors and the second pair of sensors, and plot the sensor data vs. time, wherein the rig controller is configured to determine a parameter of the tubular based on the plot of the sensor data.

Embodiment 37. The system of embodiment 36, wherein the parameter is selected from a group consisting of a presence of the tubular, a direction of travel of the tubular, a diameter of the tubular, a speed of the tubular as it passes through the entrance, an angle offset of the direction of travel of the tubular, or combinations thereof.

Embodiment 38. The system of embodiment 36, wherein the first pair of sensors and the second pair of sensors are optical sensors that detect a presence of the tubular when the tubular intersects an optical beam from the first pair of sensors and the second pair of sensors.

Embodiment 39. The system of embodiment 36, further comprising one or more fifth sensors positioned at an end of the channel of the fingerboard that is opposite the entrance of the channel.

Embodiment 40. The system of embodiment 39, wherein the one or more fifth sensors measure a distance of the tubular in the channel from the one or more fifth sensors.

Embodiment 41. The system of embodiment 40, further comprising a rig controller that is configured to determine that the tubular has reached or passed a minimum safe distance from the entrance based on the distance of the tubular in the channel from the one or more fifth sensors.

Furthermore, the illustrative methods described herein may be implemented by a system comprising a rig controller 90 that can include a non-transitory computer readable medium comprising instructions which, when executed by at least one processor of the rig controller 90, causes the processor to perform any of the methods described herein.

While the present disclosure may be susceptible to various modifications and alternative forms, specific embodiments have been shown by way of example in the drawings and tables and have been described in detail herein. However, it should be understood that the embodiments are not intended to be limited to the particular forms disclosed. Rather, the disclosure is to cover all modifications, equivalents, and alternatives falling within the spirit and scope of the disclosure as defined by the following appended claims. Further, although individual embodiments are discussed herein, the disclosure is intended to cover all combinations of these embodiments.

What is claimed is:

1. A system for conducting a subterranean operation, the system comprising:

a rig;

a fingerboard on the rig, the fingerboard having an entrance and a plurality of tubular storage locations; and a first sensor and a second sensor, with the first sensor positioned on an opposite side of the entrance from the second sensor, with the first sensor and the second sensor being configured to detect when a tubular enters or exits the fingerboard and configured to detect a parameter of the tubular as the tubular enters or exits the fingerboard, wherein the first sensor comprises a first encoder and a first arm, and wherein the first encoder detects rotation of the first arm about a first axis of the first sensor.

2. The system of claim 1, wherein the parameter is selected from a group consisting of a presence of the tubular, a direction of travel of the tubular, a diameter of the tubular, a speed of the tubular as it passes through the entrance, an angle offset of the direction of travel of the tubular, or combinations thereof.

3. The system of claim 1, wherein the first sensor comprises a first encoder and a first arm, and wherein the first encoder detects rotation of the first arm about a first axis of the first sensor, and wherein the second sensor comprises a second encoder and a second arm, and wherein the second encoder detects rotation of the second arm about a second axis of the second sensor.

4. The system of claim 3, wherein the first encoder detects a first arc length of the first arm when the first arm is rotated from a first initial position to a first rotated position, and wherein the second encoder detects a second arc length of the second arm when the second arm is rotated from a second initial position to a second rotated position.

5. The system of claim 4, further comprising a rig controller that is configured to determine a diameter of the tubular by comparing the first rotated position with the second rotated position, wherein the first arm is rotated to the first rotated position and the second arm is rotated to the second rotated position when the tubular contacts the first arm and the second arm as the tubular passes through the entrance.

6. The system of claim 4, further comprising a rig controller that is configured to compare the first arc length with the second arc length and determine an angle of tubular entry into or tubular exit from the fingerboard.

7. A system for conducting a subterranean operation, the system comprising:

a rig;

a fingerboard on the rig, the fingerboard having an entrance and a plurality of tubular storage locations;

a first sensor and a second sensor, with the first sensor positioned on an opposite side of the entrance from the second sensor, with the first sensor and the second sensor being configured to detect when a tubular enters or exits the fingerboard and configured to detect a parameter of the tubular as the tubular enters or exits the fingerboard; and a rig controller that is configured to log a first plot of a first distance of the tubular from the first sensor vs. time as the tubular moves through the entrance of the fingerboard, wherein the first sensor and the second sensor are optical sensors that detect a presence of the tubular when the tubular intersects an optical beam from either one of the optical sensors.

8. The system of claim 7, wherein the rig controller is configured to log a second plot of a second distance of the tubular from the second sensor vs. time as the tubular moves through the entrance of the fingerboard, wherein the rig controller is configured to determine at least one of 1) an angle the tubular enters or exits the fingerboard, 2) a speed the tubular enters or exits the fingerboard, and 3) a diameter of the tubular based on the first plot and the second plot.

9. The system of claim 7, further comprising one or more third sensors positioned at an end of a channel of the fingerboard and directed toward the entrance, with the entrance disposed at an opposite end of the channel, wherein the third sensors are optical sensors with optical beams directed toward the entrance, and wherein the third sensors detect when the tubular is present in the channel based on when the tubular intersects one or more of the optical beams of the third sensors.

10. The system of claim 1, further comprising:

a top drive configured to lift and lower a tubular string in a wellbore; and a rig controller that is configured to receive an indication of a detection of the tubular from the first sensor and the second sensor, and wherein the rig controller enables movement of the top drive based on reception of the indication.

11. The system of claim 6, wherein the rig controller is configured to log a first plot of the first arc length vs. time and log a second plot of the second arc length vs. time, and wherein the rig controller is configured to determine the angle of tubular entry into or tubular exit from the fingerboard based on the first plot and the second plot.

12. The system of claim 11, wherein the rig controller is configured to compare the first plot to the second plot, and the angle is determined based on the comparison of the first plot to the second plot.

13. A method for conducting a subterranean operation, the method comprising:

sensing, via first and second sensors, when a tubular is entering a fingerboard through an entrance of the fingerboard;

restricting movement of a top drive at an elevated position until the first and second sensors sense the tubular entering the fingerboard;

enabling movement of the top drive when the first and second sensors sense the tubular entering the fingerboard;

transmitting sensor data from the first and second sensors to a rig controller;

plotting the sensor data vs. time, thereby creating a first plot of the sensor data from the first sensor and a second plot of the sensor data from the second sensor;

comparing the first plot to the second plot; and determining a parameter of the tubular based on the comparing.

14. The method of claim 13, wherein enabling the movement of the top drive comprises communicating to a rig controller when the first and second sensors sense the tubular entering the fingerboard; and alerting an operator, via the rig controller, to initiate movement of the top drive toward a drill floor or initiating, via the rig controller, movement of the top drive toward a drill floor after the tubular begins to enter the fingerboard.

15. The method of claim 13, wherein the parameter is selected from a group consisting of a presence of the tubular, a direction of travel of the tubular, a diameter of the tubular, a speed of the tubular as it passes through the entrance, an angle offset of the direction of travel of the tubular, or combinations thereof.

16. The method of claim 13, wherein the first sensor comprises a first encoder and a first arm, wherein the first encoder detects rotation of the first arm about a first axis of the first sensor, wherein the second sensor comprises a second encoder and a second arm, and wherein the second encoder detects rotation of the second arm about a second axis of the second sensor.

17. The method of claim 16, further comprising:

determining, via the rig controller, a maximum rotation of the first arm and a maximum rotation of the second arm; and determining, via the rig controller, a diameter of the tubular based on a known length of the first arm and the second arm, the maximum rotation of the first arm and the second arm, and a known distance between the first axis and the second axis.

18. The method of claim 17, further comprising:

determining, via the rig controller, a speed of the tubular as the tubular passes through an entrance of the fingerboard based on the diameter of the tubular, the first plot, and the second plot.

19. The method of claim 16, further comprising:

determining, via the rig controller, an angle offset of a travel direction of the tubular as the tubular enters a channel of the fingerboard, wherein the angle offset of the travel direction is relative to a center axis of the channel.

* * * * *